US010786819B2

(12) United States Patent
Mlinar et al.

(10) Patent No.: US 10,786,819 B2
(45) Date of Patent: Sep. 29, 2020

(54) CATIONIC FLOTATION OF SILICA AND APATITE FROM OXIDIZED IRON ORES AT NATURAL PH

(71) Applicant: Regents of the University of Minnesota, Minneapolis, MN (US)

(72) Inventors: Matthew Albert Mlinar, Grand Rapids, MN (US); Tom Steven Petersen, Minneapolis, MN (US)

(73) Assignee: Regents of the University of Minnesota, Minneapolis, MN (US)

( * ) Notice: Subject to any disclaimer, the term of this patent is extended or adjusted under 35 U.S.C. 154(b) by 0 days.

(21) Appl. No.: 16/071,750

(22) PCT Filed: Jan. 20, 2017

(86) PCT No.: PCT/US2017/014372
§ 371 (c)(1),
(2) Date: Jul. 20, 2018

(87) PCT Pub. No.: WO2017/127704
PCT Pub. Date: Jul. 27, 2017

(65) Prior Publication Data

US 2019/0070616 A1 Mar. 7, 2019

Related U.S. Application Data

(60) Provisional application No. 62/281,465, filed on Jan. 21, 2016.

(51) Int. Cl.
*B03D 1/02* (2006.01)
*B03D 1/016* (2006.01)
(Continued)

(52) U.S. Cl.
CPC ..... *B03D 1/02* (2013.01); *B03D 1/01* (2013.01); *B03D 1/016* (2013.01); *B03D 1/018* (2013.01);
(Continued)

(58) Field of Classification Search
CPC ... C22B 2203/02; C22B 2203/04; C22B 1/00; C22B 1/11; C22B 1/2406; B03D 1/01; B03D 1/02; B03D 1/016; B03D 1/018
(Continued)

(56) References Cited

U.S. PATENT DOCUMENTS 2,173,090 A * 9/1939 Allingham ..... B03D 1/02 209/3
2,353,613 A * 7/1944 Gardner ..... B03B 1/02 423/152
(Continued)

FOREIGN PATENT DOCUMENTS

WO WO 2017/079276 5/2017

OTHER PUBLICATIONS

Araujo et al., "Reagents in Iron Ore Flotation," Minerals Engineering, 18(2):219-224, Feb. 2005.
(Continued)

*Primary Examiner* — Terrell H Matthews
(74) *Attorney, Agent, or Firm* — Fish & Richardson P.C.

(57) ABSTRACT

A process to beneficiate oxidized iron ore can include the steps of: (1) adding a polysaccharide to the oxidized iron ore; (2) adding at least one amine; and (3) adding at least one salt; wherein the pH of the process is below 10 and greater than 5.

27 Claims, 31 Drawing Sheets

(51) Int. Cl.

| | |
|---|---|
| ***B03D 1/01*** | (2006.01) |
| ***C22B 1/00*** | (2006.01) |
| ***C22B 1/11*** | (2006.01) |
| ***B03D 1/018*** | (2006.01) |
| ***C22B 1/24*** | (2006.01) |

(52) U.S. Cl.
CPC ..... *C22B 1/00* (2013.01); *C22B 1/11* (2013.01); *C22B 1/2406* (2013.01); *B03D 2203/04* (2013.01)

(58) Field of Classification Search
USPC ..... 209/164
See application file for complete search history.

(56) References Cited

U.S. PATENT DOCUMENTS 2,383,467 A * 8/1945 Julius ..... B03D 1/02 209/166
2,410,021 A * 10/1946 De Vaney ..... B03D 1/02 209/166
2,483,890 A * 10/1949 De Vaney ..... B03D 1/01 209/166
2,584,700 A * 2/1952 Hayward ..... C22B 1/14 423/57
2,740,522 A 4/1956 Aimone et al.
3,188,196 A * 6/1965 Skelly ..... C21B 13/0006 75/506
3,265,211 A * 8/1966 Ray ..... B03D 1/01 209/166
3,292,780 A 12/1966 Frommer et al.
3,371,778 A 3/1968 Iwasaki
3,397,953 A 8/1968 Galvin et al.
3,402,041 A 9/1968 Feld et al.
3,418,237 A 12/1968 Booth et al.
3,430,763 A * 3/1969 Iwasaki ..... B03D 1/06 209/10
3,458,044 A * 7/1969 Stockill ..... B03D 1/00 209/166
3,502,271 A * 3/1970 Hays ..... B03D 1/02 241/20
3,607,394 A 9/1971 Germino et al.
3,960,715 A * 6/1976 Dicks ..... B03D 1/02 209/166
4,139,455 A * 2/1979 Griffith ..... B03D 1/016 209/167
4,301,973 A 11/1981 Lai
4,697,744 A 10/1987 Wada et al.
5,013,359 A * 5/1991 Fair ..... B03D 1/02 209/164
5,540,336 A * 7/1996 Schreck ..... B03D 1/008 209/166
6,076,682 A 6/2000 Gustafsson et al.
2007/0138065 A1* 6/2007 Santos ..... B03D 1/016 209/166
2015/0196926 A1* 7/2015 Moreira Da Costa ... B03D 1/02 209/167

OTHER PUBLICATIONS

Balajee and Iwasaki, "Adsorption mechanism of starches in flotation and flocculation of iron ores," Trans. Aime., 244:401-6, Dec. 1969.
Chang et al., "Starches and Starch Products as Depressants in Amine Flotation of Iron Ore Mining Engineering," Trans. AIME, 196:1282-6, Jan. 1953.
Columbo and Frommer, Cationic Flotation of Mesabi Range Oxidized Taconite. Fuerstenau, M. C.: Flotation, 2(9):1285-1304. American Institute of Mining, Metallurgical, and Petroleum Engineers, Inc. 1976.
Dicks and Morrow, "Application of the selective flocculation silica flotation process to the Mesabi Range ores," InAIME Annual Meeting, Denver, Colorado 1978 (pp. 1-14).
Eisele et al., "Water Chemistry Effects in Iron Ore Concentrate Agglomeration Feed," Mineral Processing and Extractive Metallurgy Rev., 26(3-4):295-305, Jul. 2005.
International Search Report and Written Opinion in International Application No. PCT/US2017/014372 dated Mar. 31, 2017, 15 pages.
Peres et al., "Environmental impact of an etheramine utilized as flotation collector," 7th international mine water association congress. Ustron, Poland: IMWA—International Mine Water Association, pp. 464-471, 2000.
Smith and Akhtar, "Cationic Flotation of Oxides and Silicates. Fuerstenau," M. C.: Flotation vol. 1, Chapter 2, pp. 87-116. American Institute of Mining, Metallurgical, and Petroleum Engineers, Inc. 1976.
Vidyadhar et al., "Adsorption Mechanism of Mixed Cationic/Anionic Collectors in Quartz-Hematite Flotation System," Mineral Processing and Extractive Metallurgy Rev., 35(2):117-125, Mar. 2014.

* cited by examiner

SFDF Rougher-Scavenging Flowsheet

NatFlot 4-Stage Rougher Flowsheet

Figure 4: NatFlot Flowsheet (Open Circuit)

NatFlot 5-Stage Rougher Flowsheet

NatFlot Rougher-Scavenging Flowsheet

NatFlot Regrind Cleaner-Scavenging Flowsheet

NatFlot Rougher with Regrind Scavenging Flowsheet

*Fig. 26*

W O15-126/127
NatFlot Rougher-Scavenger

| Product # | Product | Wt % | Tfe % | SiO2 %* | Fe Dist % |
|---|---|---|---|---|---|
| 1 | Rghr F1/2 | 36.8 | 13.69 | 78.41 | 14.4 |
| 2 | Rghr F3 | 12.8 | 16.22 | 74.80 | 5.9 |
| 3 | Rghr F4 | 11.3 | 26.34 | 60.32 | 8.5 |
| 4 | Scav F1 | 0.6 | 35.34 | 47.44 | 0.6 |
| 5 | Scav F2 | 1.4 | 35.96 | 46.56 | 1.4 |
| 6 | Scav F3 | 1.0 | 45.56 | 32.82 | 1.3 |
| 7 | Scav Con | 4.0 | 61.08 | 7.26 | 7.1 |
| 8 | Rghr Con | 32.0 | 66.31 | 2.61 | 60.7 |
| | **Total** | **100.0** | **34.98** | **47.65** | **100.0** |

Combined Products

| Product | Wt % | Tfe % | SiO2 %* | Fe Rec % |
|---|---|---|---|---|
| CC | 32.0 | 66.31 | 2.61 | 60.7 |
| CC+SC | 36.1 | 65.72 | 3.13 | 67.8 |
| CC+SC+Scav3 | 37.1 | 65.17 | 3.94 | 69.1 |
| CC+SC+Scav3+Scav2 | 38.5 | 64.12 | 5.47 | 70.5 |
| CC+SC+Scav3+Scav2+Scav1 | 39.1 | 63.67 | 6.13 | 71.1 |

*Note: Scav Con and Rghr Con silica assays measured directly; all other silica assays estimated by assuming a 98% oxide total

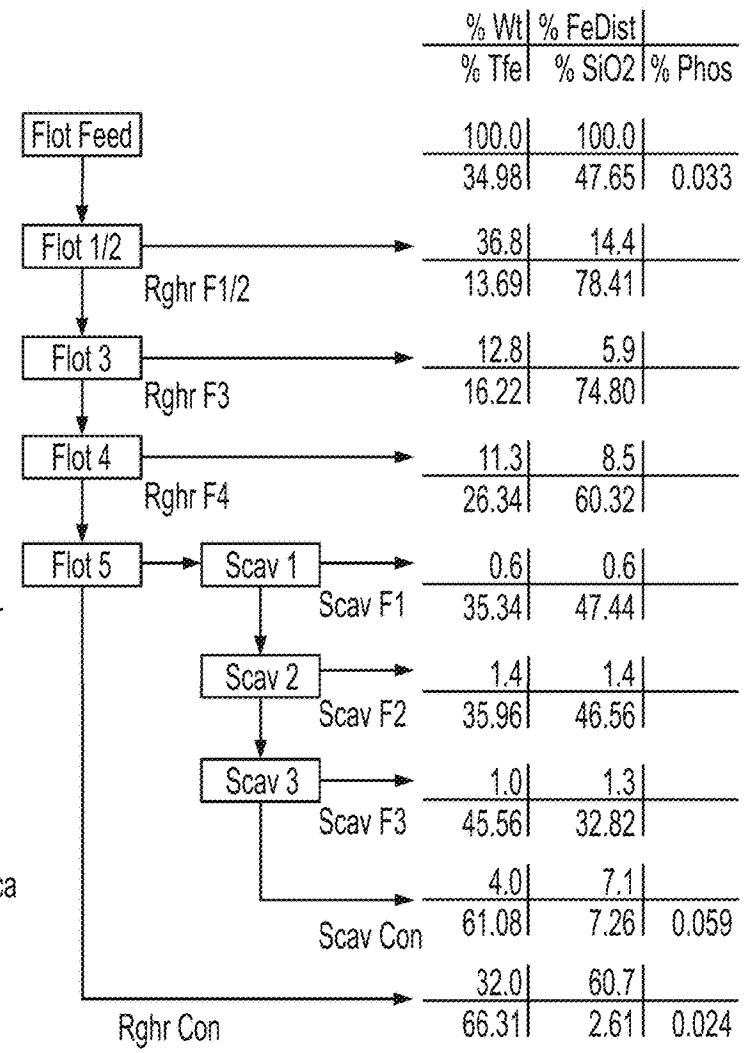

*Fig. 27*

W O15-119/120
NatFlot Regrind-Scavenger

| Product # | Product | Wt % | Tfe % | SiO2 % | Fe Dist % |
|---|---|---|---|---|---|
| 1 | Rghr F1/2 | 34.0 | 13.10 | 79.25 | 12.73 |
| 2 | Rghr F3 | 13.9 | 14.19 | 77.69 | 5.64 |
| 3 | Rghr F4 | 12.0 | 24.81 | 62.50 | 8.48 |
| 4 | Scav F1 | 1.9 | 28.77 | 56.84 | 1.56 |
| 5 | Scav F2 | 1.0 | 39.96 | 40.83 | 1.09 |
| 6 | Scav F3 | 0.6 | 50.30 | 26.04 | 0.93 |
| 7 | Scav Con | 2.8 | 62.65 | 5.76 | 4.97 |
| 8 | Clean Con | 33.8 | 66.91 | 2.56 | 64.59 |
| | **Total** | **100.0** | **35.02** | **47.92** | **100.0** |

Combined Products

| Product | Wt % | Tfe % | SiO2 % | Fe Rec % |
|---|---|---|---|---|
| CC | 33.8 | 66.91 | 2.56 | 64.6 |
| CC+SC | * 36.6 | 66.59 | 2.80 | 69.6 |
| CC+SC+Scav3 | * 37.2 | 66.30 | 3.21 | 70.5 |
| CC+SC+Scav3+Scav2 | * 38.2 | 65.64 | 4.15 | 71.6 |
| CC+SC+Scav3+Scav2+Scav1 | 40.1 | 63.90 | 6.64 | 73.1 |

*Note: Scav Con and Rghr Con silica assays measured directly; all other silica assays estimated by assuming a 98% oxide total

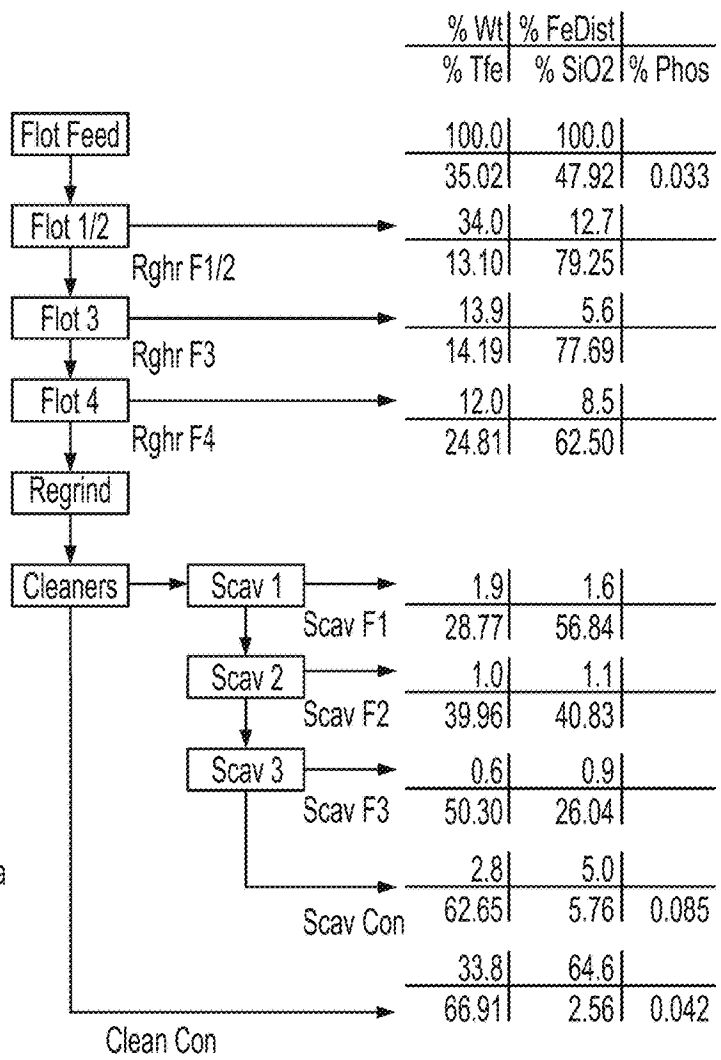

*Fig. 28*

W O15-130/131
NatFlot Rougher-Scavenger

| Product # | Product | Wt % | Tfe % | SiO2 % | Fe Dist % |
|---|---|---|---|---|---|
| 1 | Rghr F1/2 | 38.1 | 13.72 | 78.37 | 14.9 |
| 2 | Rghr F3 | 13.4 | 16.51 | 74.38 | 6.3 |
| 3 | Rghr F4 | 10.1 | 28.17 | 57.70 | 8.1 |
| 4 | Scav F1 | 0.2 | 48.41 | 28.74 | 0.2 |
| 5 | Scav F2 | 0.9 | 44.35 | 34.55 | 1.1 |
| 6 | Scav F3 | 0.6 | 46.72 | 31.16 | 0.8 |
| 7 | Scav F4 | 0.8 | 49.83 | 26.71 | 1.2 |
| 8 | Scav Con | 4.1 | 57.30 | 9.24 | 6.7 |
| 9 | Rghr Con | 31.8 | 67.08 | 2.71 | 60.7 |
| | **Total** | **100.0** | **35.14** | **47.66** | **100.0** |

Combined Products

| Product | Wt % | Tfe % | SiO2 % | Fe Rec % |
|---|---|---|---|---|
| CC | 31.8 | 67.08 | 2.71 | 60.7 |
| CC+SC | * 35.9 | 65.96 | 3.46 | 67.4 |
| CC+SC+Scav4 | * 36.8 | 65.58 | 4.00 | 68.6 |
| CC+SC+Scav4+Scav3 | * 37.4 | 65.28 | 4.44 | 69.4 |
| CC+SC+Scav4+Scav3+Scav2 | * 38.3 | 64.78 | 5.51 | 70.5 |
| CC+SC+Scav4+Scav3+Scav2+Scav2 | * 38.4 | 64.72 | 5.24 | 70.8 |

*Note: Scav Con and Rghr Con silica assays measured directly; all other silica assays estimated by assuming a 98% oxide total

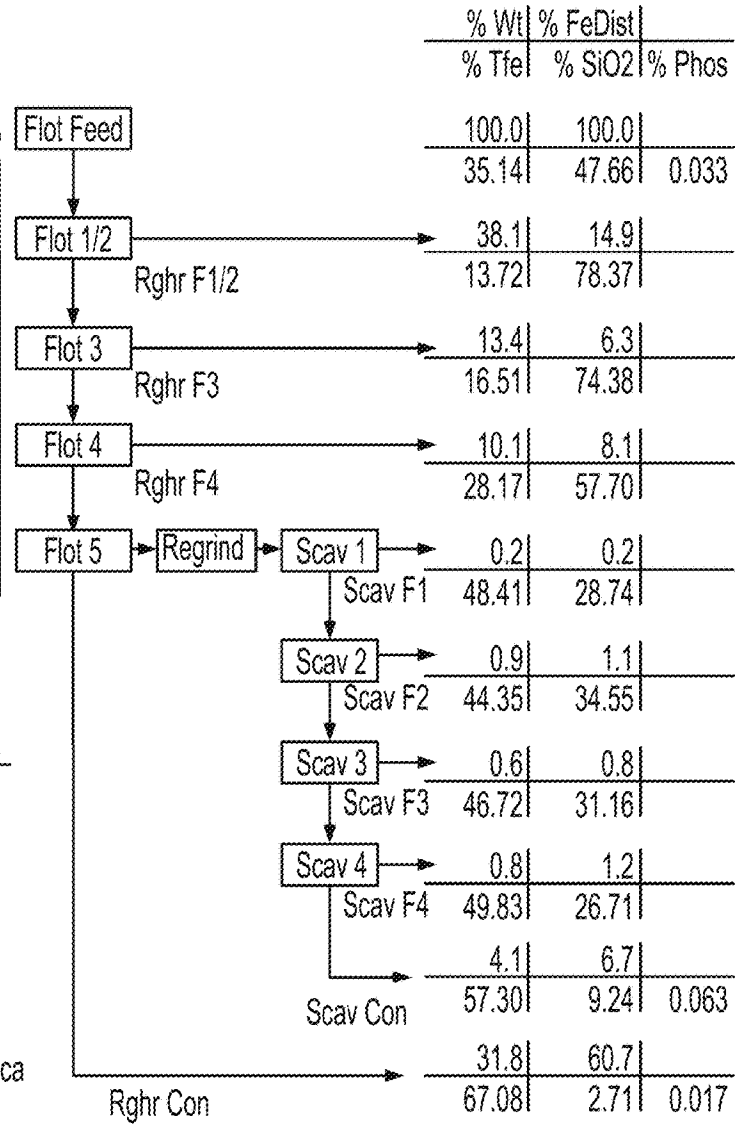

CATIONIC FLOTATION OF SILICA AND APATITE FROM OXIDIZED IRON ORES AT NATURAL PH

CROSS-REFERENCE TO RELATED APPLICATIONS

This application is a National Stage application under 35 U.S.C. § 371 of International Application No. PCT/US2017/014372, having an International Filing Date of Jan. 20, 2017, which claims the benefit of priority under 35 U.S.C. § 119(e) to U.S. Application No. 62/281,465 filed Jan. 21, 2016.

TECHNICAL FIELD

Methods of beneficiating low grade iron ores

BACKGROUND OF THE INVENTION

A least one existing commercial selective flocculation desliming-cationic silica flotation ("SFDF") process used at Cliffs' Tilden Mine is carried out at a pH of 11 and requires a significant amount of reagents to maintain the high pH and then neutralize the slurry pH before filtering. Due to the highly charged mineral surfaces at the high pH the process is run at, process water chemistry is critical and water treatment is expensive. Developing a process at a natural pH would significantly reduce the costs of process reagents and water treatment chemicals. The process would be more tolerant to process water hardness and alkalinities. The challenge is to effectively beneficiate the ore with a neutral pH process that does not rely on desliming to enable flotation to selectively remove the silica gangue and produce a concentrate for a blast furnace grade pellet.

The existing technology is a process that operates at an elevated pH between 10.5 and 11.2 and is higher cost, less selective, utilizes many more chemical reagents to control the process and has significant environmental concerns. The existing technology also concentrates phosphorus (in the form of apatite) in flotation which is undesirable to pellet consumers.

SUMMARY OF THE INVENTION

In some aspects, a process to beneficiate oxidized iron ore includes the steps of: (1) adding a polysaccharide to the oxidized iron ore; (2) adding at least one amine; and (3) adding at least one salt; wherein the pH of the process is below 10 and greater than 5.

In some embodiments, the polysaccharide can include a polysaccharide carbohydrate $(C_6H_{10}O_5)_n$ containing of a number of glucose monosaccharide units joined together by glycosidic bonds, wherein n ranges from 2 to 1,000 inclusive. In some embodiments, the polysaccharide can be a causticized starch. In some embodiments, the at least one amine can include an alkyl amine having between 2-20 carbons. In some embodiments, the at least one amine can be dodecyl amine. In some embodiments, the at least one amine can be an aromatic amine having between 6-40 carbon atoms. In some embodiments, the at least one amine can be a cycloaliphatic amine. In some embodiments, the at least one salt can contain a cation such as magnesium, calcium and sodium. In some embodiments, the at least one salt can include a divalent cation. In some embodiments, the said at least one divalent cation can be selected from the group consisting of magnesium and calcium. In some embodiments, said pH can be between 6 to 9 inclusive. In some embodiments, said step of adding at least one amine can include adding at least one amine in two or more stages. In some embodiments, said step of adding at least one amine can include adding at least one amine in three or more stages. In some embodiments, said step of adding at least one amine can include adding at least one amine in four or more stages. In some embodiments, no desliming step is performed in the process. In some embodiments, said step of adding at least one amine can include adding at least one amine in five or more stages. In some embodiments, said step of adding at least one amine can include adding at least one amine in between 2 to 5 stages inclusive. In some embodiments, said step of adding at least one amine can include adding at least one amine in between 3 to 5 stages inclusive.

In some embodiments, said step of adding at least one amine can include adding at least one amine in between 4 to 5 stages inclusive. In some embodiments, the process can further include the step of adding at least one polyphosphate activator. In some embodiments, a beneficiated iron ore concentrate can contain less than or equal to 0.100% phosphorus. In some embodiments, the beneficiated iron ore concentrate can contain less than or equal to 0.020% phosphorus.

In some aspects, a process to beneficiate oxidized iron ore includes the steps of: (1) adding a causticized starch to the oxidized iron ore; (2) adding at least one amine to the oxidized iron ore; (3) adding at least one polyphosphate activator; and (4) adding at least one salt; wherein the pH of the process is between approximately 6 and 9 inclusive; and wherein no desliming step is performed.

In some embodiments, the step of adding at least one amine at least one time can be a staged addition of amine. In some embodiments, a beneficiated iron ore concentrate can contain less than or equal to 0.100% phosphorus. In some embodiments, the beneficiated iron ore concentrate can contain less than or equal to 0.050% phosphorus. In some embodiments, the beneficiated iron ore concentrate can contain less than or equal to 0.020% phosphorus.

Various embodiments provided herein may be broadly described as the use of starch and a polyphosphate activator while floating silica and apatite (phosphorus) at a neutral or natural pH (e.g., pH ranging from about 6 to about 9, or, in some embodiments, from about 6 to about 10) to beneficiate low grade iron ores without a desliming step. The flotation procedure can include a staged addition of an amine collector The process further includes the conditioning of process water with suitable levels of divalent cations and anions. Divalent cations are the predominant actors in modifying the zeta potential of the mineral surface and can often be used in offsetting the surface charge modification of iron ore in a rising pH environment. In contrast, monovalent cations do not typically have adequate charge modification ability, while trivalent cations typically lack the desired selectively for the processes described herein. Various suitable types of anion can be used in the processes described herein. In some embodiments, the use of carbonate anions ($CO^{3-}$) anions can provide the benefits of high availability, low cost, and a low environmental impact. In some embodiments, exemplary suitable anions can also include sulfates. In some embodiments, the process excludes a polyphosphate activator, while, in some embodiments, the process includes the addition of a polyphosphate activator to enhance silica and apatite flotation.

The processes provided herein can provide the benefit of reducing chemical reagent usage and costs and can also recover more of the iron which lowers tailings disposal, reduces the amount of ore mined, allows more iron formation to be mined, and extends the life of the ore resources in the mining area. It allows some of the iron mineral deposits to be mined as ore that were not amenable with previously used processes. The processes provided herein can also lower the phosphorus levels in the ore concentrate to levels that meet the specifications of most pellet consumers in the Great Lakes area.

In some embodiments, the processes provided herein can be run at a neutral or natural pH, which is defined herein to be a pH between about 5 to about 10 (e.g., between 6 to 9). It is believed that performing the process in this pH range can reduce the complexity and high costs of the current selective flocculation desliming, cationic silica flotation (SFDF) process. For example, is believed to be less costly, less complex and more robust than the high pH SFDF process used today. The processes provided herein are more selective and produce a higher grade product at lower costs. For example, is more selective in its separation of gangue minerals such as quartz and apatite from the iron minerals and therefore results in higher iron recoveries with higher iron grade concentrates. This allows more of the reserves to be economically processed and reduces the amount of stripping and tailings to be disposed of. More of the Minnesota and other iron deposits around the world can be economically developed and existing mine life can be economically extended. The processes provided herein can also reduce the chemicals needed in the processing of fine grained oxidized ores. The reduction in stripping, tailings and chemical usage is a significant environmental advantage.

In some embodiments, the processes provided herein can be used to remove silica, apatite and other gangue minerals from ores such as magnetite, hematite, martite, goethite, siderite or any other mineral of value that contains these gangue minerals. In addition to being applicable to fully oxidized iron formations, this process can also be used on a typical Minnesota magnetic taconite ore as they normally have a certain percentage of oxidized iron ore minerals associated with the magnetite. It is not unusual for a magnetic taconite to contain two thirds magnetite and one third hematite whereby the hematite is lost to tailings with the current low intensity magnetic separation techniques used today. This process will not only recover the magnetite, but recover a significant amount of hematite as well.

In accordance with some aspects of the present disclosure, there is provided a natural pH flotation (denoted as "NatFlot" in this text) of silica in iron ores that is successful when the appropriate amounts of ions are present in the process water to effectively promote starch as an iron depressant. The NatFlot process developed in this study was done on an iron ore sample provided by a current mining operation and is considered an oxidized ore containing martite, hematite and goethite iron minerals and mostly quartz as a gangue mineral.

The NatFlot process had a higher metallurgical performance than the standard selective flocculation desliming, cationic silica flotation (SFDF) process being used commercially today. The commercial SFDF process is run at a system pH of approximately 11.0 and requires significant amounts of reagents for pH control, dispersion of silica slimes, selective flocculation and depressing the iron minerals, water treatment, filtering aids and tailings flocculation. Because of the elevated pH, these reagents are used at rather high levels and contribute to the high costs of the operation. In some embodiments, the NatFlot process can operate at the natural pH of the system and only use starch as a flotation depressant, polyphosphate as a flotation activator, and amine as a flotation collector for floating the silica and apatite. In some embodiments, the processes provided herein includes an addition of calcium and magnesium salts (e.g., CaCO3 and MgCO3) to maintain optimized water chemistry for the process which will result in minimal processing costs. The filter aids and tailings flocculation costs used commercially are expected to be reduced because of the near neutral pH of the system.

The oxidized iron ore sample (denoted as Type 3) used in this test work is a rather poor ore that had a lower than normal recovery and did not make target concentrate iron and silica grade in the standard lab bench SFDF test. The NatFlot process increased the weight recovery by 27% at the same concentrate grade of 64% total iron while grinding to coarser as compared to the SFDF process. Whereas the SFDF test made only a 64% total iron concentrate, the NatFlot process regularly produced concentrate grades at 66.5% total iron and 3% silica. The selectivity of the NatFlot process with this ore is much better than the SFDF process. The amine collector usage was 60% lower. The majority of the testing was also conducted at a coarser grind; grinds were approximately 80% passing 25 micron for the UMD NRRI testing versus approximately 87% passing 25 micron for the mining company baseline testing.

The NatFlot process produces a much cleaner concentrate as far as some of the other minor gangue minerals. For example, with the addition of polyphosphate reagent, the flotation of apatite occurs with the existing amine collector in parallel with the silica. In the example provided herein, the result was a concentrate with 0.020% phosphorus that meets typical low phosphorus specifications in the Great Lakes area steel mills. In some cases, the NatFlot process can produce a concentrate of less than or equal to 0.100% phosphorus. In some cases, the NatFlot processes provided herein can produce an ore concentrate containing less than or equal to 0.050% phosphorus, less than or equal to 0.040% phosphorus, less than or equal to 0.030% phosphorus, less than or equal to 0.025% phosphorus; or less than or equal to 0.020% phosphorus. In some cases, the NatFlot processes provided herein can produce an ore concentrate containing a range of about 0.005% to about 0.1%, about 0.09%, about 0.08%, about 0.07%, about 0.05%, about 0.03%, or about 0.01%, inclusive; about 0.01% to about 0.1%, about 0.09%, about 0.08%, about 0.07%, about 0.05%, or about 0.03%, inclusive; about 0.05% to 0.1%, about 0.09%, about 0.08%, or about 0.07%, inclusive; about 0.07% to about 0.1%, about 0.09%, or about 0.08%, inclusive; about 0.08% to about 0.1%, or about 0.09%, inclusive; or about 0.09% to about 0.1%, inclusive, of phosphorus.

Furthermore the NatFlot process, with or without polyphosphate reagent, very effectively floats MgO and $Al_2O_3$ minerals to produce a concentrate much lower in this chemistry.

With the current shift in industry toward producing direct reduced grade (DRG) concentrates, an exploratory test was run utilizing a rougher concentrate regrind and concentrate cleaner step to target a 2% silica DRG concentrate with the tested ore. A concentrate was produced at 67.6% total iron and 1.97% silica at a 51.5% iron recovery. This low silica value and the associated low levels of $Al_2O_3$ in the NatFlot concentrates opens the door for additional research to investigate producing DRG concentrates.

An initial preliminary attempt to compare the annual costs of a typical 8 million ton pellet operation between the high pH SFDF and NatFlot processes projected estimated annual reagent savings to be $10 to $20 million.

These and other objects of this disclosure will be evident when viewed in light of the detailed description and appended claims.

BRIEF DESCRIPTION OF THE DRAWINGS

FIG. 26 is a set of metallurgical balance tables and a flowsheet for a NatFlot Rougher-Scavenger test;

FIG. 27 is a set of metallurgical balance tables and a flowsheet for a NatFlot Rougher-Scavenger test;

FIG. 28 is a set of metallurgical balance tables and a flowsheet for a NatFlot Rougher-Scavenger test;

DETAILED DESCRIPTION OF THE INVENTION

The examples and figures provided herein are illustrative only and not meant to limit the disclosure to solely those embodiments shown in the examples and figures.

Figure 1:
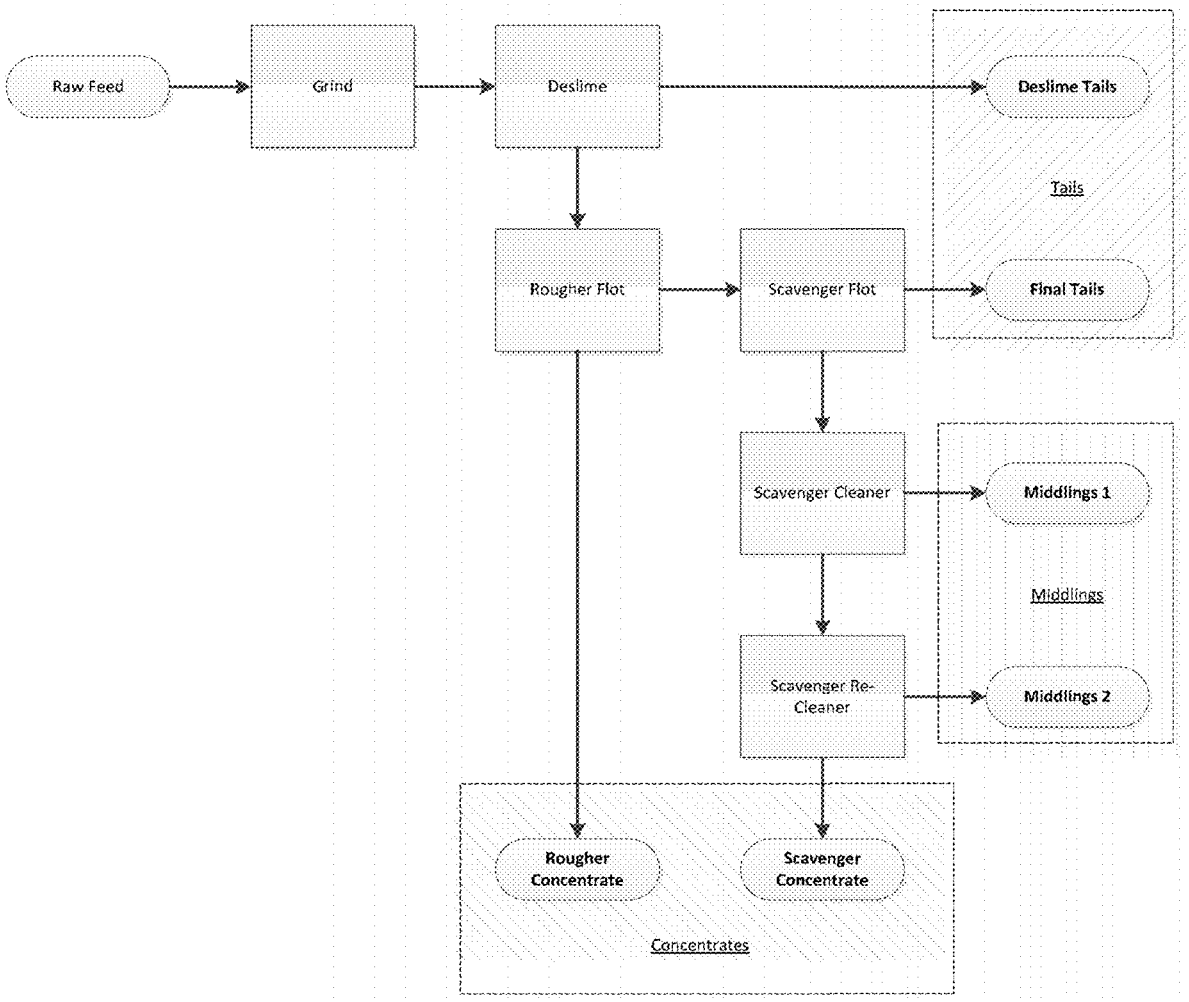
FIG. 1 is a flowsheet of Tilden high pH Selective Flocculation/Deslime/Flotation ("SFDF") flowsheet.

The disclosure relates to the improvement to the commercially used high pH selective flocculation desliming-cationic silica flotation (SFDF) process which focuses on removing the gangue minerals from the iron oxide minerals in an attempt to recover a high percentage all of the iron oxide and carbonate minerals. This would include magnetite, hematite (and its associated oxidized iron ore minerals) and siderite. The SFDF process used in commercial operations is a very effective mineral processing flowsheet for fine grained oxidized iron ores and is dependent on operating at an elevated pH of 10.5 to 11.0 to enable the starch to act as a selective flocculant in the desliming step prior to flotation. The number and amounts of reagents needed in this flowsheet is rather expensive and presents significant environmental considerations. The alternative is to develop a flowsheet that will work at a natural or neutral pH which will significantly reduce reagent usage. The standard SFDF bench test flowsheet can be seen in FIG. 1.

At least one aspect described in this disclosure was the development of an alternative flowsheet at a natural pH that would duplicate or exceed the grade and recovery performance of the SFDF process used commercially. The initial work involved an ore sample supplied by a mining company in Michigan. This ore sample was a blend of three ore sites and was characterized in the poorer ore quality range of the ore blends found at this mining site. This was determined to be a good ore sample to use in this investigation for this very reason. If this ore can be made to respond positively to the new flowsheet, it should also work on the higher quality ores.

The natural pH flotation (denoted as NatFlot in this text) of silica in iron ores is successful when the appropriate amounts of ions are present in the process water to effectively promote starch as an iron depressant. The NatFlot process developed in this study was performed on an iron ore sample provided by a current mining operation and is considered an oxidized ore containing martite, hematite and goethite iron minerals and mostly quartz as a gangue mineral.

By all metrics employed, the NatFlot process outperformed the standard SFDF being used commercially today. The commercial SFDF process is run at a system pH of 11.0 and requires significant amounts of reagents for pH control, dispersion of silica slimes, selective flocculation and depression of the iron minerals, water treatment, filtering aids and tailings flocculation. Because of the elevated pH, these reagents are used at rather high levels and contribute to the high costs of the operation. The NatFlot process operates at a more natural pH of the system and only uses starch as a flotation depressant and amine as a flotation collector for floating the silica. Moreover, the addition of calcium and magnesium salts can help to maintain optimized water for the process, which in turn minimizes processing costs. The filter aids and tailings flocculation costs used commercially are expected to be reduced because of the near neutral pH of the system.

Various embodiments provided herein may be broadly described as the use of starch as a flotation depressant of iron minerals and a polyphosphate activator while floating silica and apatite (phosphorus) at a more neutral or natural pH (between pH of 6 to 9) to beneficiate low grade iron ores without a desliming step. The flotation procedures described herein can include a staged addition of an amine collector which improves flotation selectivity and prevents unmanageable frothing characteristics which would be unacceptable in a commercial operation. The processes provided herein can further include the conditioning of process water with suitable levels of divalent cations and anions to enhance the depressant nature of starch on iron minerals to prevent them from floating and reporting to the tails.

Table 1 below provides key tests and results thereof.

TABLE 1

| Description | Flowsheet | % −25 μm | Float pH | Water Used | Slime % wt. | Slime % Fe | Conc % Fe | Conc % $SiO_2$ | Conc % WtRec | Conc % FeRec | Interp conc % WtRec | Interp conc % FeRec | Interp conc % WtRec | Interp conc % FeRec |
|---|---|---|---|---|---|---|---|---|---|---|---|---|---|---|
| Optimized High pH Baseline | SFDF Rougher | 78.8 | 10.57 | 25:1 High pH | 5.17 | 6.83 | 63.91 | 4.45 | 30.58 | 55.44 | N/A | N/A | N/A | N/A |
| NatFlot Baseline | NatFlot 5-Stage Rougher | 79.7 | 7.16 | tap | N/A | N/A | 66.20 | 3.13 | 31.03 | 59.18 | 34.93 | 65.33 | N/A | N/A |
| NatFlot with 100% DI $H_2O$ | NatFlot 5-Stage Rougher | ~82 | 8.24 | DI | N/A | N/A | 65.01 | 4.36 | 34.93 | 64.96 | 34.95 | 64.98 | N/A | N/A |
| NatFlot with 100% tap $H_2O$ | NatFlot 5-Stage Rougher | ~82 | 7.44 | tap | N/A | N/A | 66.00 | 3.69 | 36.04 | 67.67 | 38.07 | 70.29 | N/A | N/A |
| "4-test" tap baseline | NatFlot Rougher | ~82 | ~7.5 | tap | N/A | N/A | 66.23 | 3.27 | 33.10 | 62.64 | 36.84 | 68.38 | N/A | N/A |
| NatFlot with Ca/Mg | NatFlot 5-Stage Rougher | ~82 | 7.90 | DI w/ reagents | N/A | N/A | 64.96 | 4.90 | 36.30 | 67.28 | 36.31 | 67.30 | N/A | N/A |
| NatFlot Rougher with Regrind-cleaner low $SiO_2$ | NatFlot Regrind-Cleaner | 85.4 (regrind) | 7.18 | tap | N/A | N/A | 67.56 | 1.97 | 26.51 | 51.21 | 35.40 | 65.67 | 30.98 | 58.91 |
| NatFlot Rougher with Regrind-cleaner | NatFlot Regrind-Cleaner | 93.8 (regrind) | 7.27 | tap | N/A | N/A | 67.14 | 2.54 | 30.99 | 59.48 | 35.86 | 66.62 | 32.90 | 62.54 |
| NatFlot w/0.25 #/LT Glass H | NatFlot 5-Stage Rougher | ~82 | 7.40 | tap | N/A | N/A | 67.48 | 2.76 | 28.50 | 54.46 | 36.29 | 66.65 | 31.92 | 60.01 |
| NatFlot Rougher Scavenger baseline | NatFlot Rougher Scavenger | 95.5 | 7.68 | tap | N/A | N/A | 66.31 | 2.61 | 32.04 | 60.74 | 37.32 | 69.34 | N/A | N/A |
| NatFlot Rougher w/Regrind-Scavenger baseline | NatFlot Rougher w/Regrind-Scavenger | 89.8 (regrind) | 7.20 | tap | N/A | N/A | 67.08 | 2.71 | 31.78 | 60.66 | 37.87 | 70.04 | 33.91 | 64.14 |
| NatFlot Regrind-Cleaner-Scavenger baseline | NatFlot Regrind-Cleaner-Scavenger | 95.1 (regrind) | 7.53 | tap | N/A | N/A | 66.91 | 2.56 | 33.81 | 64.59 | 38.89 | 72.16 | 36.78 | 69.85 |

Desliming in the SFDF process relies on the starch to selectively flocculate the fine iron in a highly mineral dispersed environment. This requires the system to be at a pH of 10 to 11 in order for starch to effectively act as a selective flocculant for the iron minerals and prevent high iron losses in the deslime thickener. The deslime operation is critical in the SFDF flowsheet for flotation to be selective and to reduce the amount of very stable froth generated with a poorly deslimed flotation feed. The flotation selectivity relies on the starch to depress the iron minerals from floating in spite of the highly negative surface charge on the iron mineral. Because of the high pH, the SFDF process requires high levels of amine collector in flotation to upgrade the ore. Since the froth produced with the amine collector is mineral stabilized, excessive amounts of fine silica slimes in the flotation feed coupled with the high amine addition will produce a very stable voluminous froth that is very difficult to handle in a commercial operation. The use of a scavenger circuit in the commercial operation also complicates the froth problem because of the recirculation of fine iron and amine back to the rougher flotation circuit.

The NatFlot process does not require a desliming step. This is why it can be operated at a natural pH of the system that can range between 6 and 9. The reason that desliming is not required in the NatFlot process is the highly selective nature of the natural pH flotation and the significantly reduced amine collector dosage needed. The other key factors for good selectivity are the adjusted water chemistry, the low dosage stage addition of amine, starch as a depressant, and the elimination of the recirculated scavenger concentrate. In some embodiments, the first increments of amine collector to the ground ore are low in dosage and are very selective and produce a very manageable froth. These first flotation stages will selectively float ultrafine silica slimes and the subsequent amine additions can be increased as needed to float the amount of silica required to produce the desired concentrate grade. The froth generated in the subsequent amine stages is devoid of fine silica and becomes very manageable. The high selectivity of flotation also reduces the need for a scavenger circuit. In some embodiments, the last froth increments of the multi-stage rougher float may be scavenged and the scavenger concentrate sent to a dedicated scavenger cleaner flotation circuit.

The ore sample (denoted as Type 3) used in this test work was a rather poor ore that had a lower than normal recovery and did not make target concentrate iron and silica grade in the standard lab bench SFDF test. The NatFlot process increased the weight recovery by 27% at the same concentrate grade of 64% total iron with a coarser grind. Whereas the SFDF test could only make a 64% total iron concentrate, the NatFlot process produced concentrate grades as high as 67% total iron and 3% silica. In addition, the NatFlot process with an added concentrate cleaner flot produced a direct reduce grade (DRG) concentrate of 67.6% total iron and 1.97% silica at a 51.5% iron recovery with a regrind step. The selectivity of the NatFlot process with this ore was much better than the SFDF process. The amine collector usage was 60% lower. The majority of the testing was also conducted at a coarser grind; grinds were approximately 80% passing 25 micron for the UMD NRRI testing versus approximately 87% passing 25 micron for the mining company baseline testing.

Figure 2:
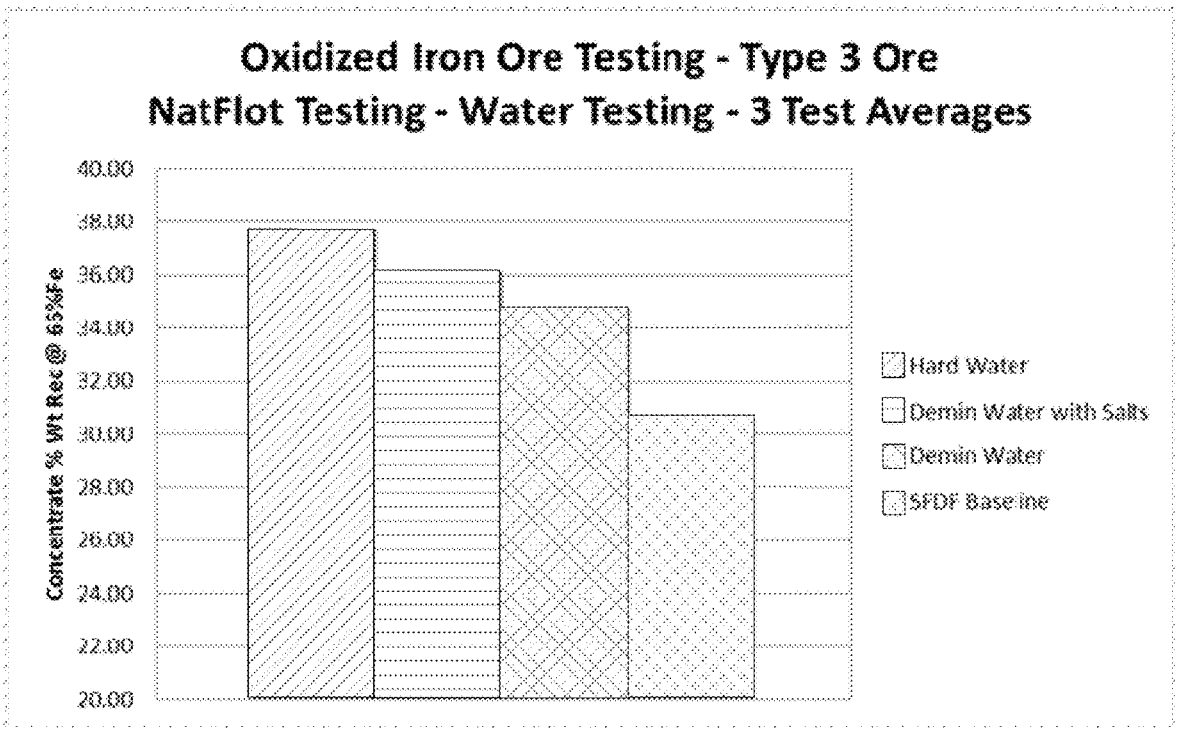
FIG. 2 is a bar graph result summary of NatFlot by water type.

The conditioning of the process water to higher calcium and magnesium levels gave better selectivity in flotation. The use of naturally hard waters worked the best, but even demineralized water could be adjusted with various calcium and magnesium salts to approach the same results. FIG. 2 displays a summary of the flotation results by water type.

The NatFlot process with water containing high levels of ions gave the best results. The other options of using softer water were less than optimal, but still were significantly better than the baseline SFDF flowsheet. The NatFlot process was tested at various pH levels and the results were consistently good between pH 6 to pH 9. At pH 10 and above the results became significantly poorer.

With the current shift in industry toward producing direct reduce grade (DRG) concentrates, an exploratory test was run utilizing a regrind and concentrate cleaner step to target a 2% silica DRG concentrate with this ore. A concentrate was produced at 67.6% total iron and 1.97% silica at a 51.5% iron recovery.

An attempt was made to compare the annual costs of a typical 8 million ton pellet operation between the high pH SFDF and NatFlot processes. The projected annual reagent savings is estimated to be $10 to $20 million. If the recovery is factored in, the annual savings could be even higher.

The first task was to process this ore using the standard SFDF high pH bench test to duplicate the mining company's bench test result. The UMD NRRI testing compared very well with the mining company test result using the standard scavenger test procedure. The UMD NRRI baseline testing was done with both the staged amine test (to get a grade vs. recovery curve) and the scavenger test (to optimize recovery) procedures. The standard mining company's test was ground to 87% passing 25 micron (−500 mesh) while the UMD NRRI tests were typically ground to approximately 80% passing 25 micron (−500 mesh). Table 1 displays the mining company's baseline data.

TABLE 1

Mining Company Baseline Data

| Head | Starch | Grind % 500M | % Fe Assay | % CaO | % MgO | % Mn | % $Al_2O_3$ | % P | % M-Fe | % Fe Calc'd |
|---|---|---|---|---|---|---|---|---|---|---|
| Bulk sample HPGR | Pearl | 86.6 | 33.4 | 0.35 | 1.48 | 0.13 | 2.13 | 0.039 | 9.5 | 33.7 |

| Concentrate | % Fe | % $SiO_2$ | % wt. | % Fe Rec | Total Oxide | % P |
|---|---|---|---|---|---|---|
| Bulk sample HPGR | 61.3 | 6.54 | 33.2 | 60.5 | 94.2 | 0.051 |

The UMD NRRI water blends involve mixing demineralized water with tap water. The UMD NRRI tap water typically contains approximately 88 ppm of $Ca^{++}$ and 30 ppm of $Mg^{++}$ ions. The 8:1 blend of demineralized to tap is based on achieving a 10 ppm $Ca^{++}$ ion content water. The 25:1 blend has a $Ca^{++}$ ion content of 4 ppm. This water is then adjusted to pH 10.5 with caustic soda which will precipitate the $Mg^{++}$ ions as $Mg(OH)_2$. This provides water ions with minimum and maximum values that approximate process water used at the mining operation.

The starches used were the standard unmodified pearl starch used in the mining company's lab test and the modified starch currently used in their process. The preparation procedures used for the starch employed autoclave cooked and causticized methods. The mining company used the cooking method in their lab and plant. Causticizing of starch was utilized at UMD NRRI because of its simplicity and effectiveness.

Figure 3:
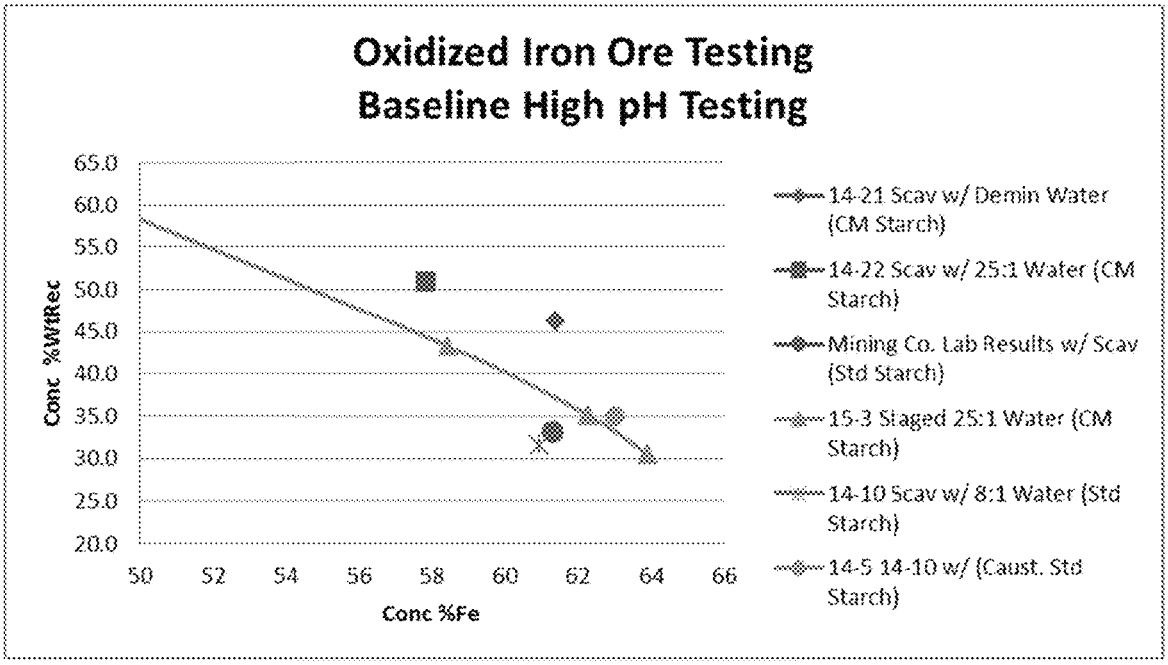
FIG. 3 is a graph of oxidized ore testing comparison.

FIG. 3 shows the baseline test results of the mining company lab result, the UMD NRRI duplication tests using the 8:1 water, 25:1 water, demineralized water and starches prepared by autoclave and causticizing. The mining company lab test was closely duplicated by Test 14-10 using the same starch and water ionic loading (8:1 blend). The use of causticized standard (unmodified) starch in Test 14-5 improved both grade and recovery. Using lower-ionic water and the causticized modified starch in Tests 14-21 and 14-22 significantly improved recovery. Demineralized water is not practical for an industrial operation; therefore the 25:1 water blend was selected as the baseline water for this flowsheet development program. The mining company has demonstrated that this low ion-loaded process water (4 ppm $Ca^{++}$) can be maintained in an industrial operation. The causticized modified starch (CMStarch) was also selected as the baseline starch for this program. The combination of these two factors gave the best grade/recovery in the high pH SFDF flowsheet on the bench. It was determined that any new natural or neutral pH flowsheet would have to be compared to these SFDF optimal conditions.

The staged amine flotation Test 15-3 gives a grade/recovery relationship of the SFDF flowsheet on this ore with the 25:1 water and CMStarch. This test did not use the scavenger flotation step and had a lower final recovery, but this will be relative in the staged amine testing done at the natural/neutral pH. The advantage of the staged test is that the recovery at a certain grade concentrate for all tests can be determined by interpolation. In some embodiments, the use of a scavenger circuit may be applicable.

Figure 4A:
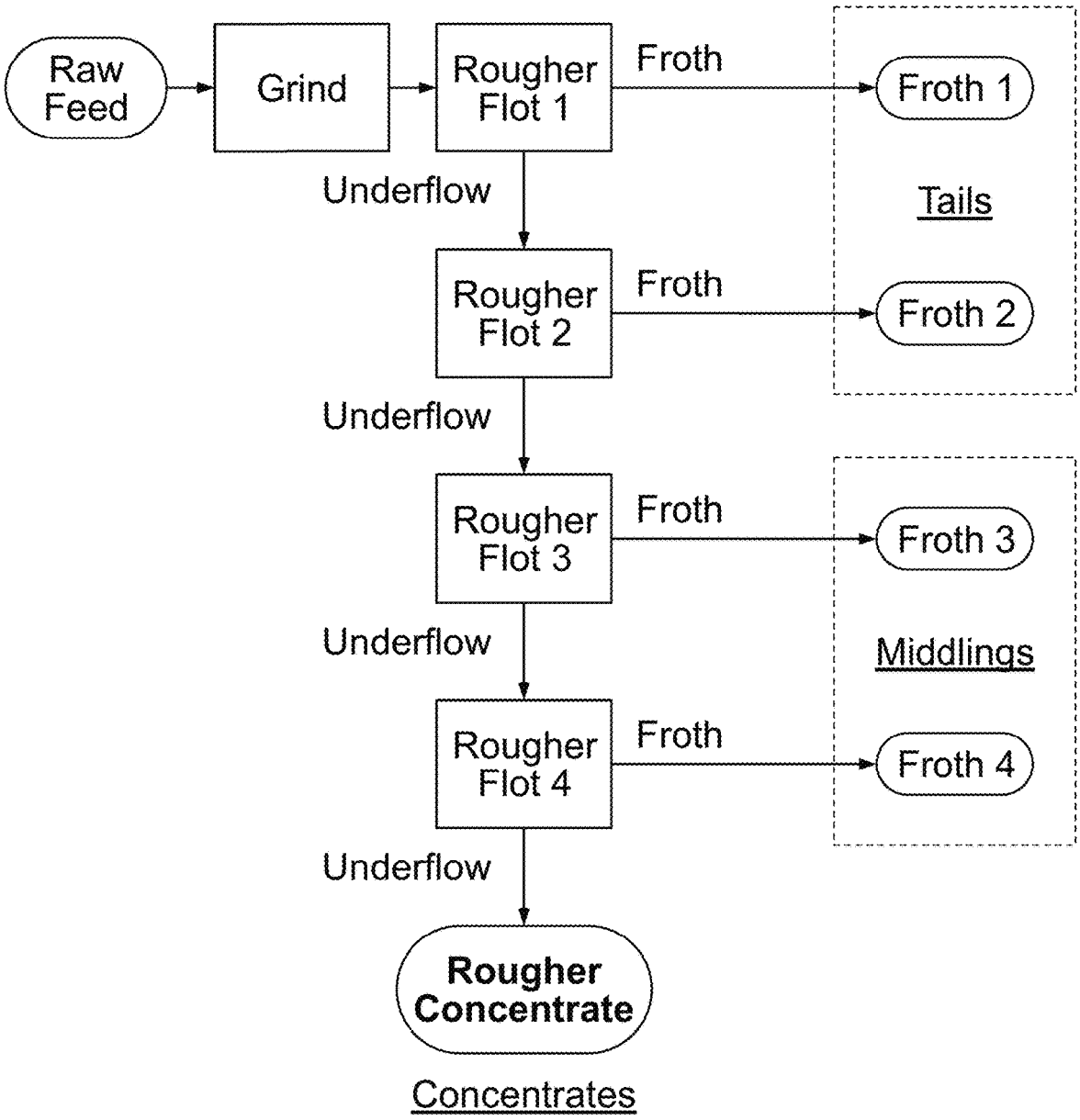
FIGS. 4A and 4B are flowsheets of exemplary NatFlot processes (open circuit)
Figure 4B:
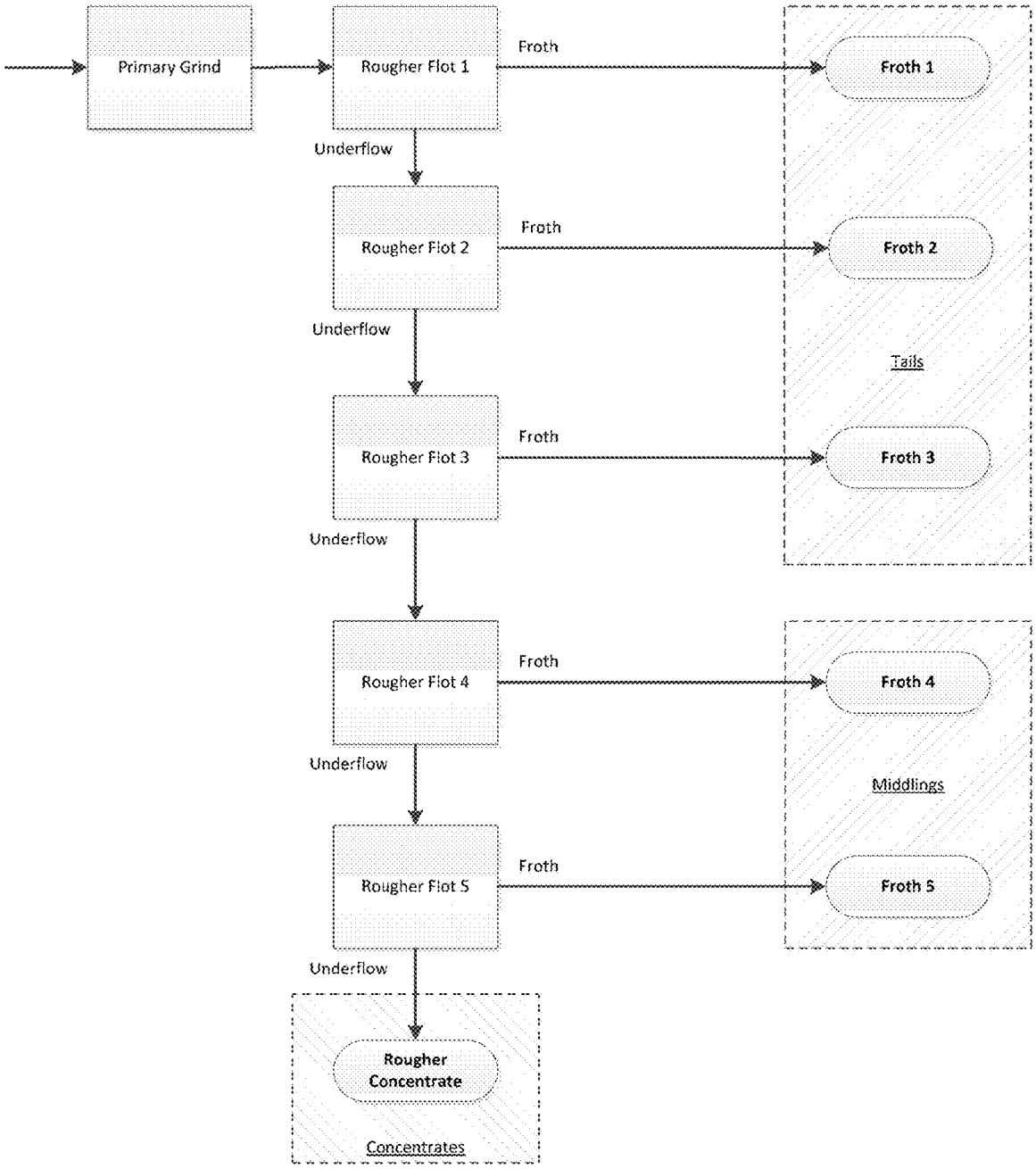

The NatFlot initial test procedure only utilized two of the SFDF process reagents, CMStarch as a flotation iron depressant and PA-12 amine (dodecyl amine) in flotation. The caustic soda and sodium silicate typically used in the high pH flowsheet were eliminated and the ore went directly from grinding to flotation. Deslime thickening was not utilized. The initial four stage flowsheet for the NatFlot process can be seen in FIG. 4A. The five stage flowsheet for the NatFlot process is shown in FIG. 4B.

Figure 5:
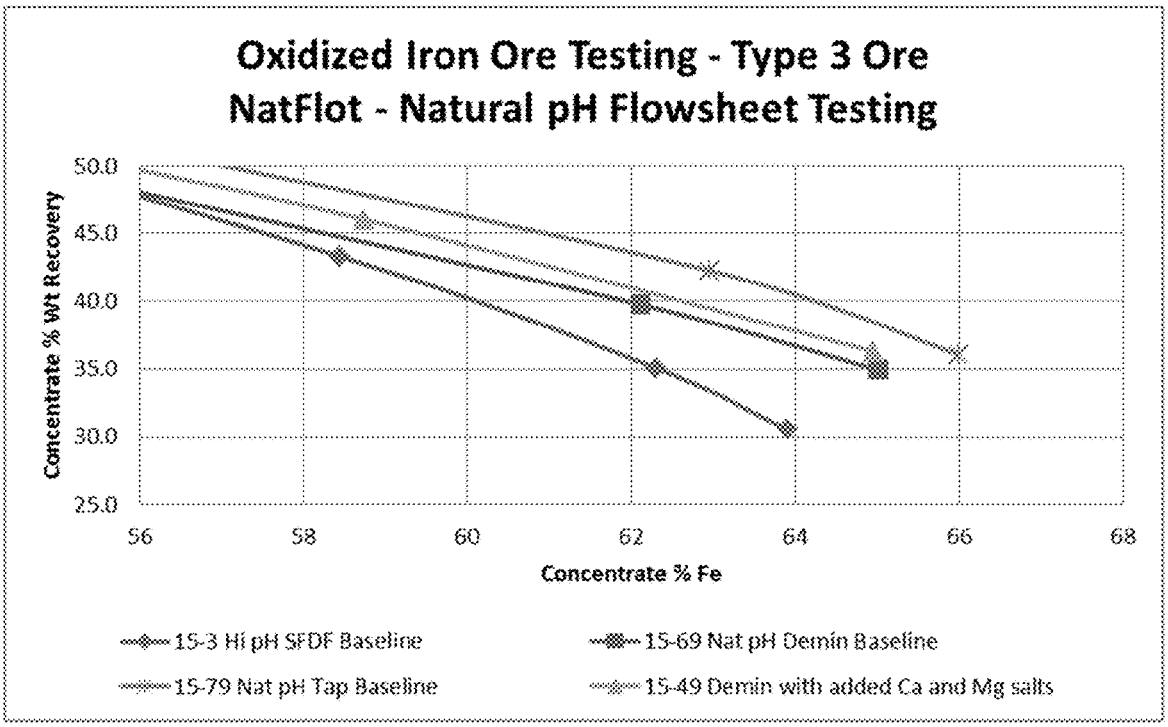
FIG. 5 is a graph of NatFlot grade vs. recovery.

FIG. 5 illustrates an alternative embodiment of the invention. Test 15-79 was run with UMD NRRI tap water that contains 88 ppm of $Ca^{++}$ ions and 30 ppm $Mg^{++}$ ions. The ore was ground without any reagents and the ground ore was not deslimed, it went directly to flotation. CMStarch was added (1.5#/T) and conditioned for 2 minutes and then five stages of flotation were performed with amine increments of 0.05, 0.05, 0.05, 0.10 and 0.10 pound per ton (#/T). The weight recovery was 27% higher than the SFDF baseline Test 15-3 at equivalent 64% total iron concentrate grade. Test 15-69 was run with 100% demineralized water and compared to tap water the recovery dropped 5%. Test 15-49 was run with demineralized water with Ca and Mg salts added in an effort to simulate the hard (Tap) water results. The natural high ion loading of the UMD NRRI tap water was most beneficial to the NatFlot flowsheet.

Figure 6:
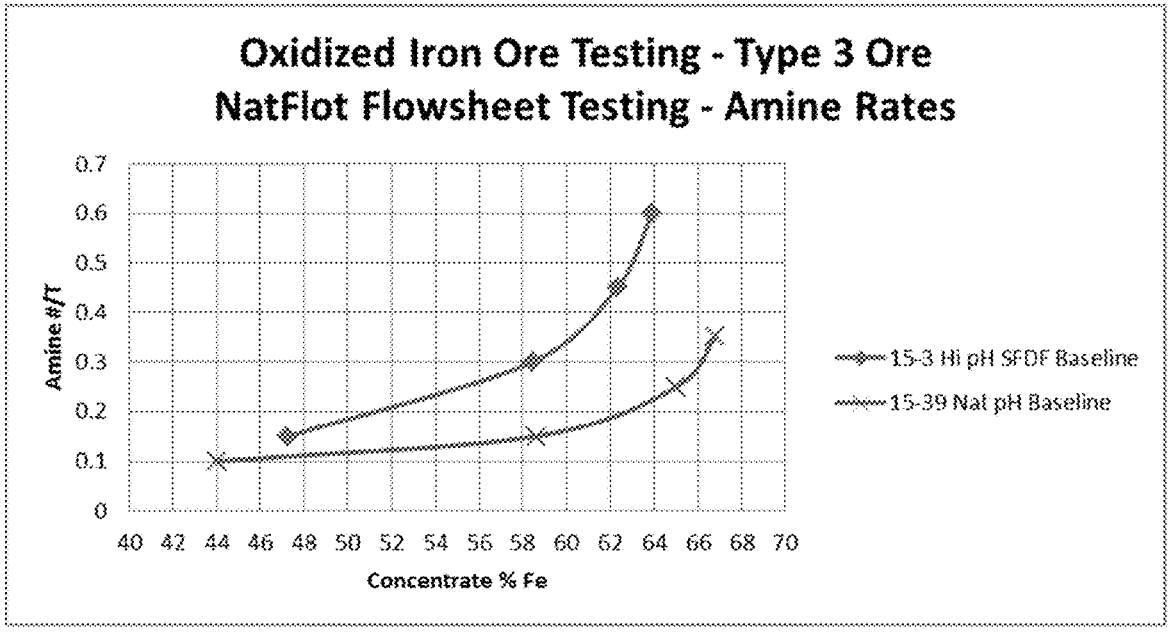
FIG. 6 is a graph of amine rate comparison for NatFlot vs. SFDF.

FIG. 6 shows the amine dosage effect on concentrate grade for the natural and high pH flowsheets. The NatFlot flowsheet can produce higher concentrate iron grades than the SFDF flowsheet with much lower amine collector usage. At a 64% total iron concentrate grade, the NatFlot process used 0.23#/T of amine compared to 0.60#/T with the SFDF process, a reduction of 62% amine.

Figure 7:
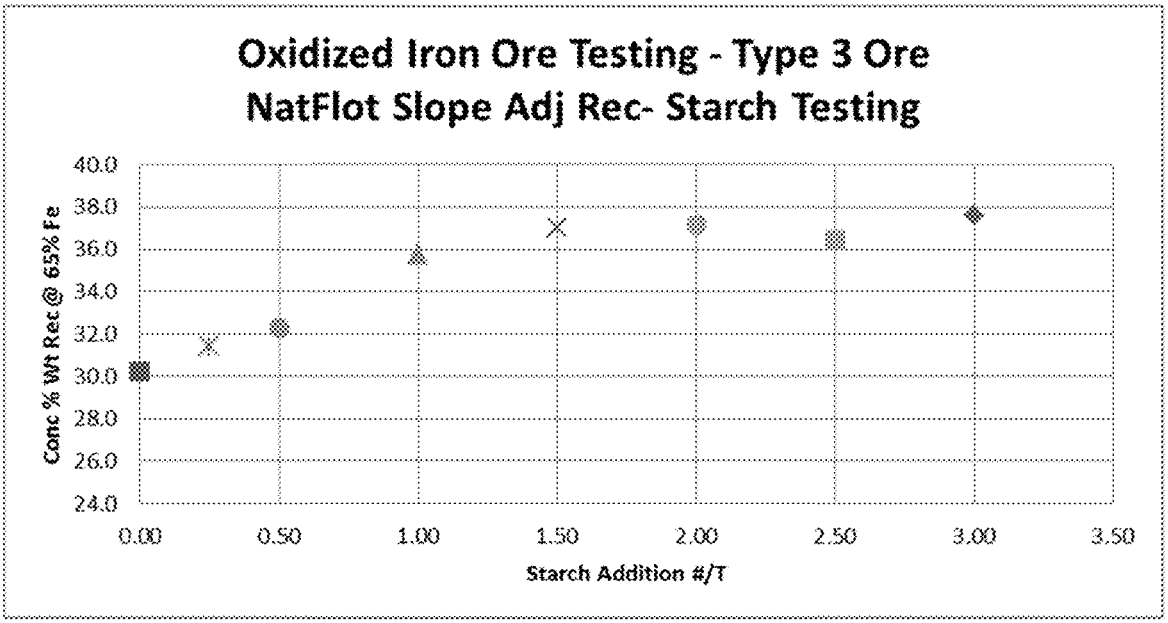
FIG. 7 is a graph of NatFlot and SFDF grade vs. recovery evaluation of starch.

The effect of starch as a flotation depressant is shown in FIG. 7. The weight recovery increased with increasing starch until the 1.5#/T rate and then leveled off.

Figure 8:
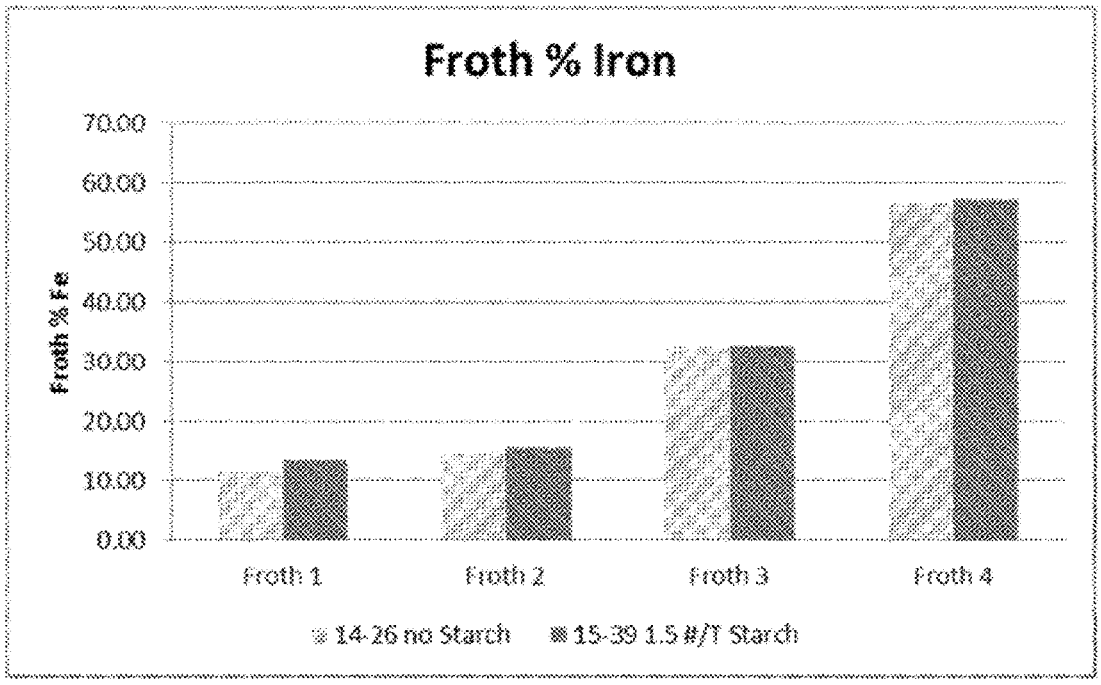
FIG. 8 is a bar graph of percent total iron by froth product.
Figure 9:
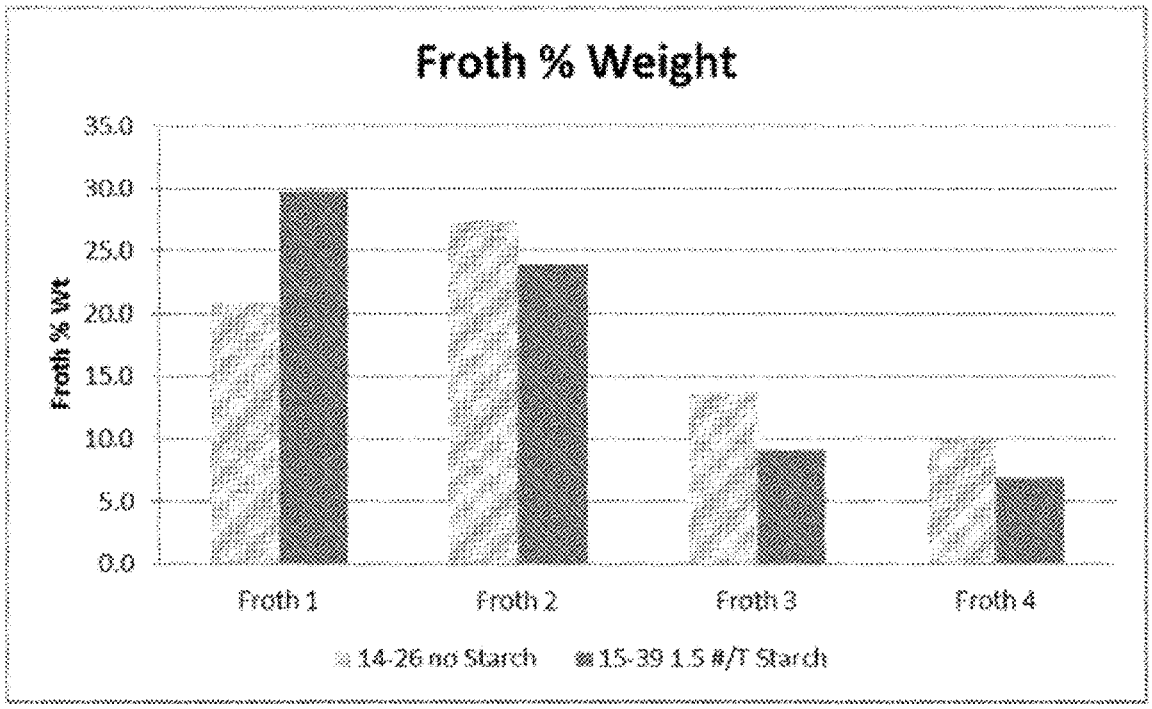
FIG. 9 is a bar graph of percent weight by froth product.
Figure 10:
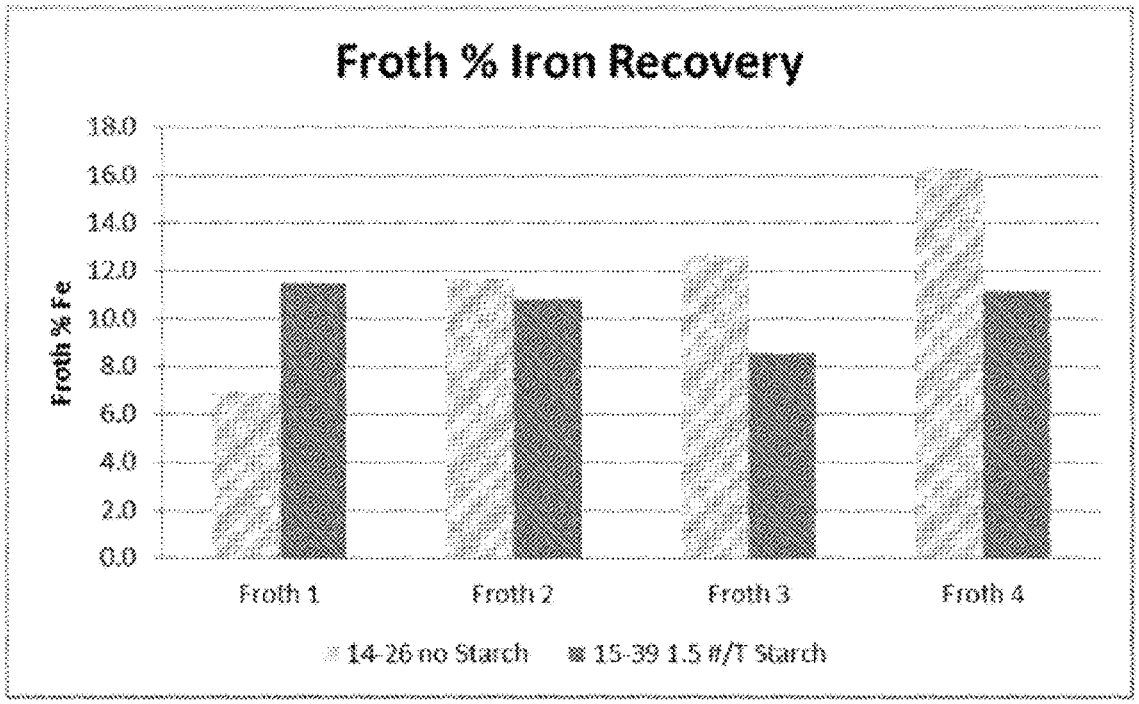
FIG. 10 is a bar graph of percent iron distribution by froth product.

FIGS. 8-10 display the percent total iron, percent weight, and percent iron distribution for each of the four froth products, respectively. The use of starch allows more material to float in the first amine stage when the tailings grade is low in iron. This is most likely due to the starch preventing amine adsorption on the iron mineral and making it more available to float silica. Starch is also effective in preventing iron from floating in the last two amine stages when the collector levels are elevated in an effort to float the middlings to make target grade. Without starch, the iron loss in the last two stages is much higher than the tests with starch added.

Figure 11:
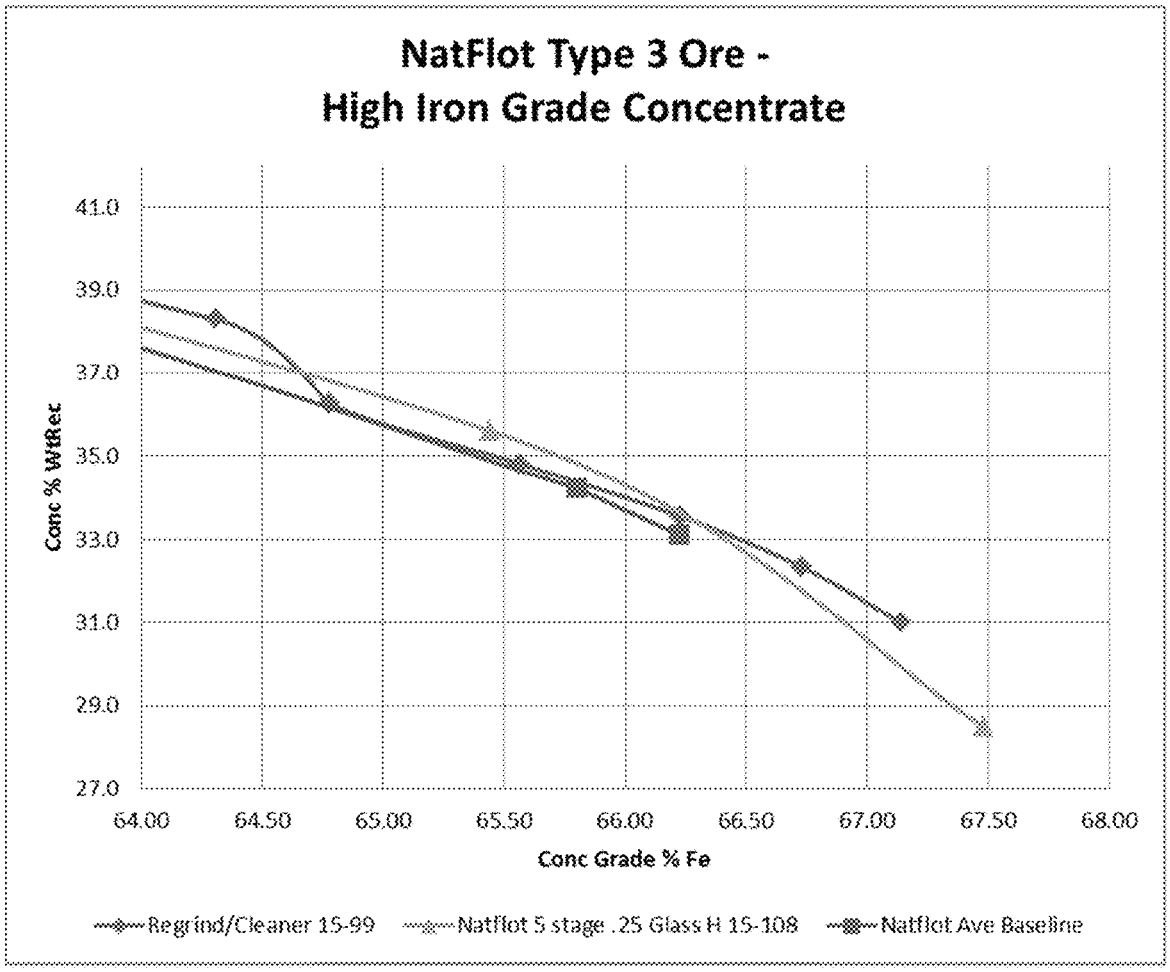
FIG. 11 is a graph of grade/recovery for high iron grade concentrates.

The NatFlot process has the ability to produce a higher grade concentrate than the SFDF high pH process. For example, the basic NatFlot process can make a concentrate iron grade of 66% total iron. Adding a polyphosphate reagent and regrinding the rougher concentrate to 93%-500 mesh showed concentrate iron grades approaching 67.5% total iron and silica content between 2.0 and 2.5%. FIG. 11 displays the grade/recovery relationship for the high iron grade concentrate tests.

Figure 12:
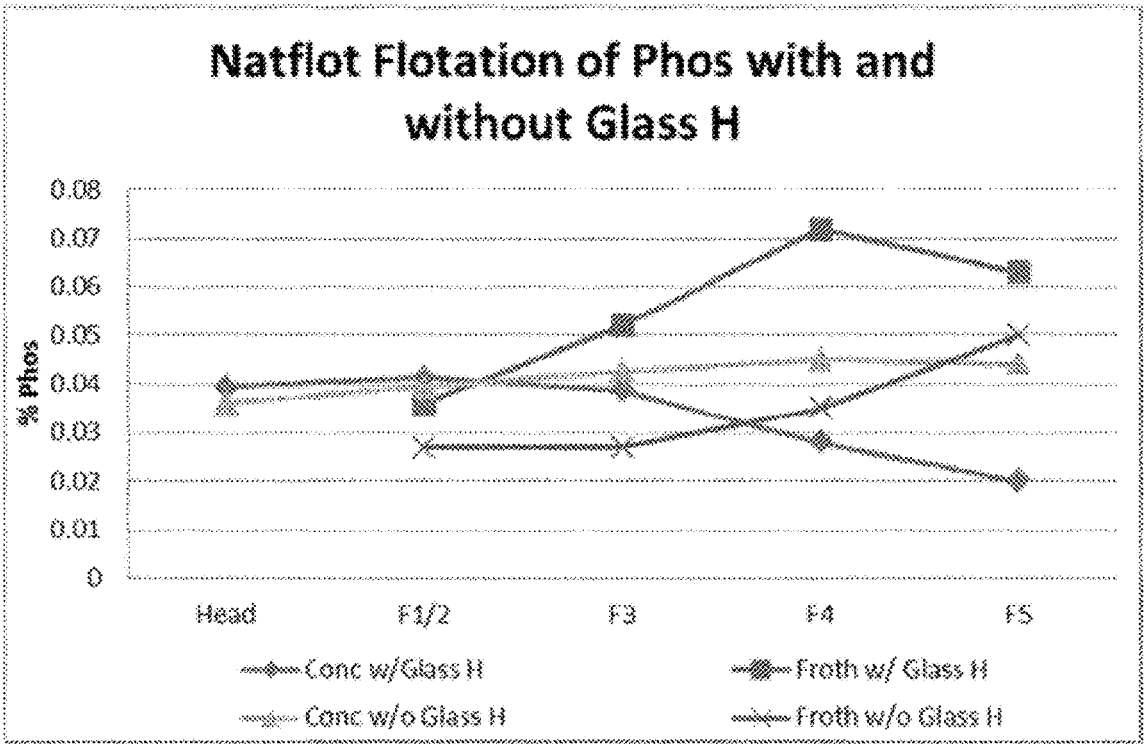
FIG. 12 is a graph of influence of polyphosphate reagent with NatFlot process on phosphorus content.
Figure 13:
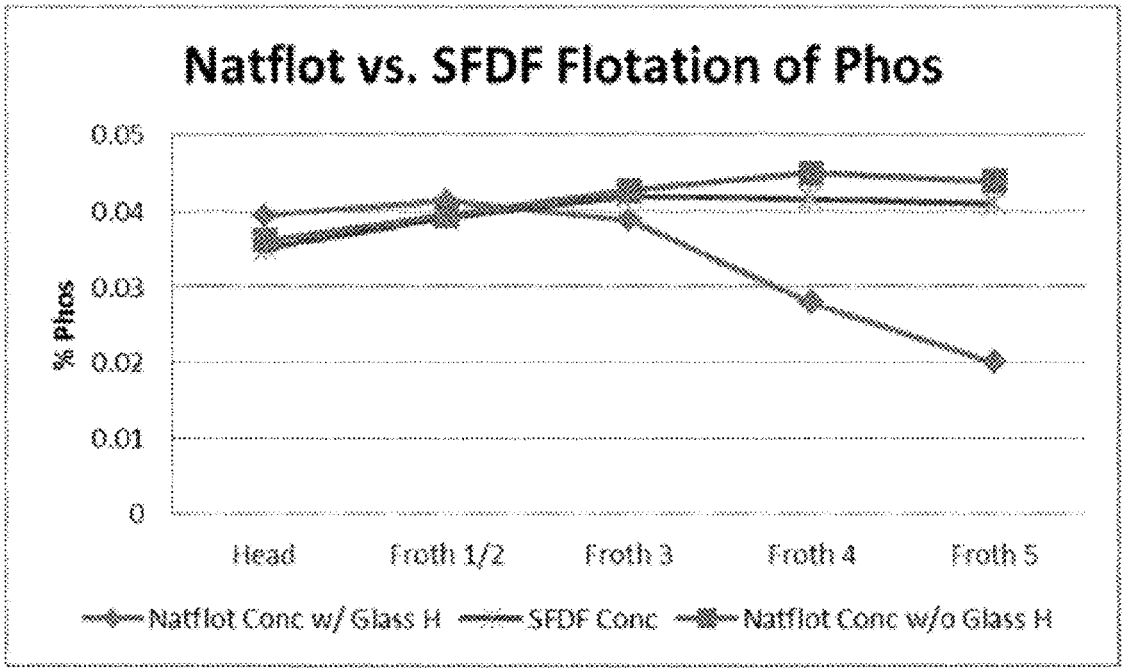
FIG. 13 is a graph of comparison of phosphorus content per product with NatFlot and SFDF.

The phosphorus levels of the concentrate produced with the mining company's lab SFDF test was 0.051% whereas the UMD NRRI optimized SFDF phosphorus was 0.041%. The baseline NatFlot tap water Test 14-23 had a concentrate phosphorus of 0.042%. Furthermore, the iron and silica oxide total of the for the mining company's lab result was 94.2% compared to Test 14-23 with an oxide total of 97.7%. As is common with the SFDF process, the phosphorus content of the concentrate was higher than other comparable blast furnace grade concentrates. By adding polyphosphate reagent to the grind, flotation will activate and remove apatite and therefore phosphorus along with the silica. FIG. 12 illustrates the impact of the polyphosphate reagent addition per product and FIG. 13 is a graph of comparison of phosphorus content per product with NatFlot and SFDF.

Figure 14:
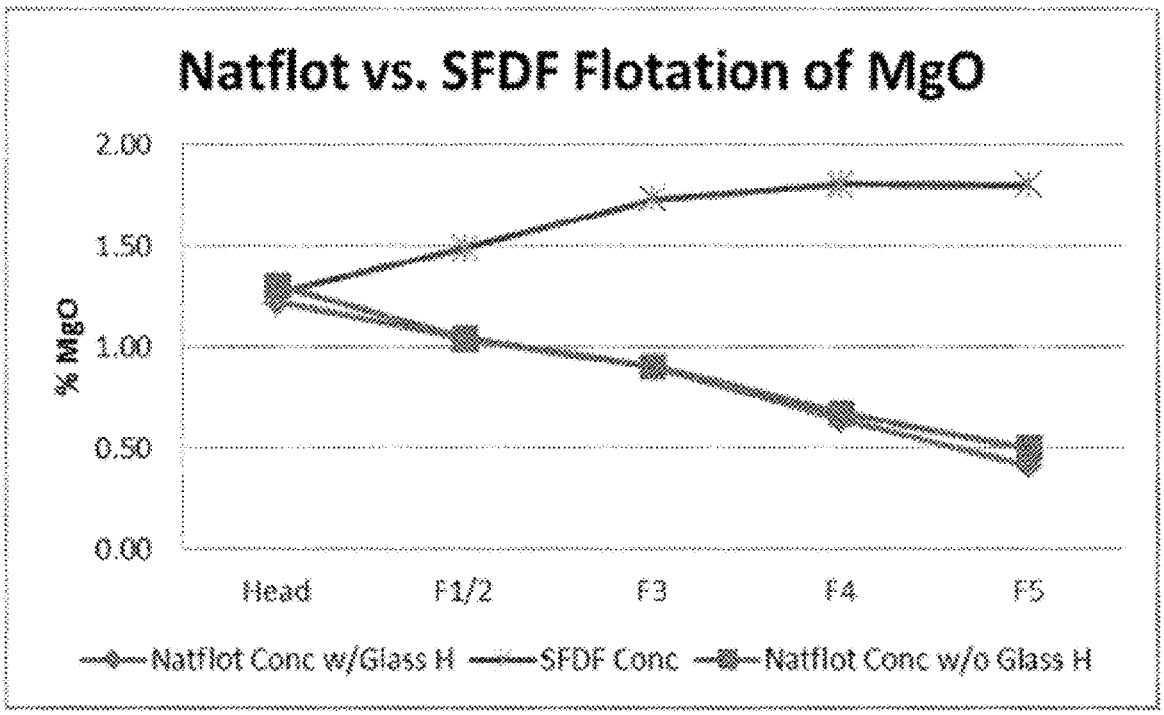
FIG. 14 is a graph of NatFlot vs SFDF concentrate MgO content.
Figure 15:
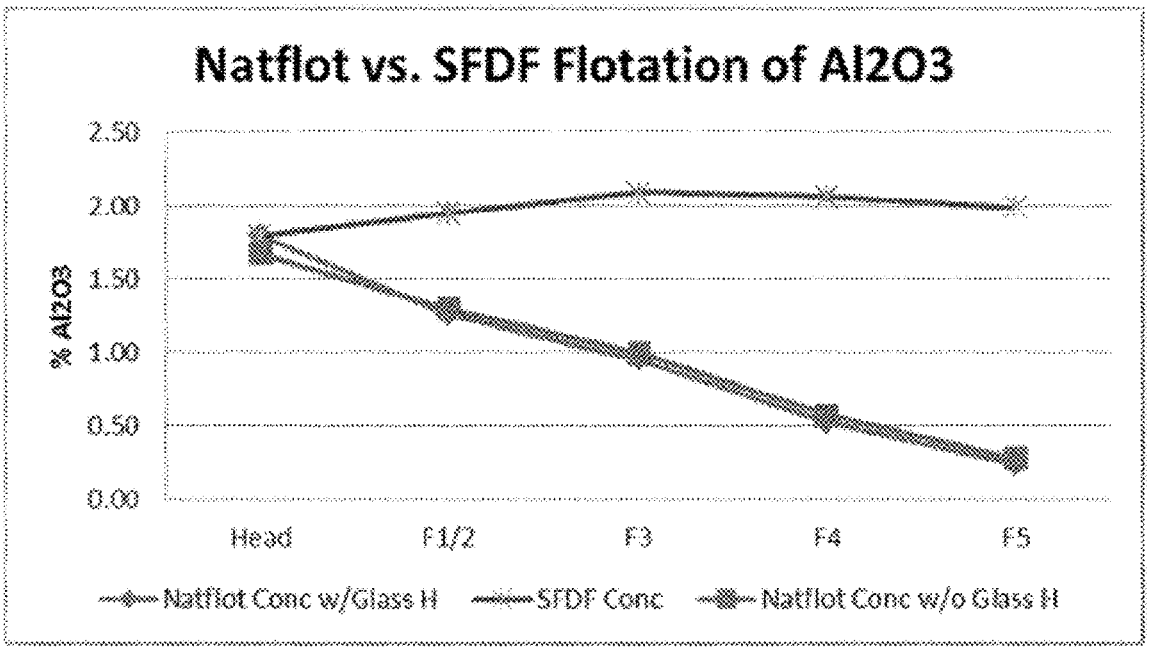
FIG. 15 is a graph of NatFlot vs SFDF concentrate $Al_2O_3$ content.
Figure 16:
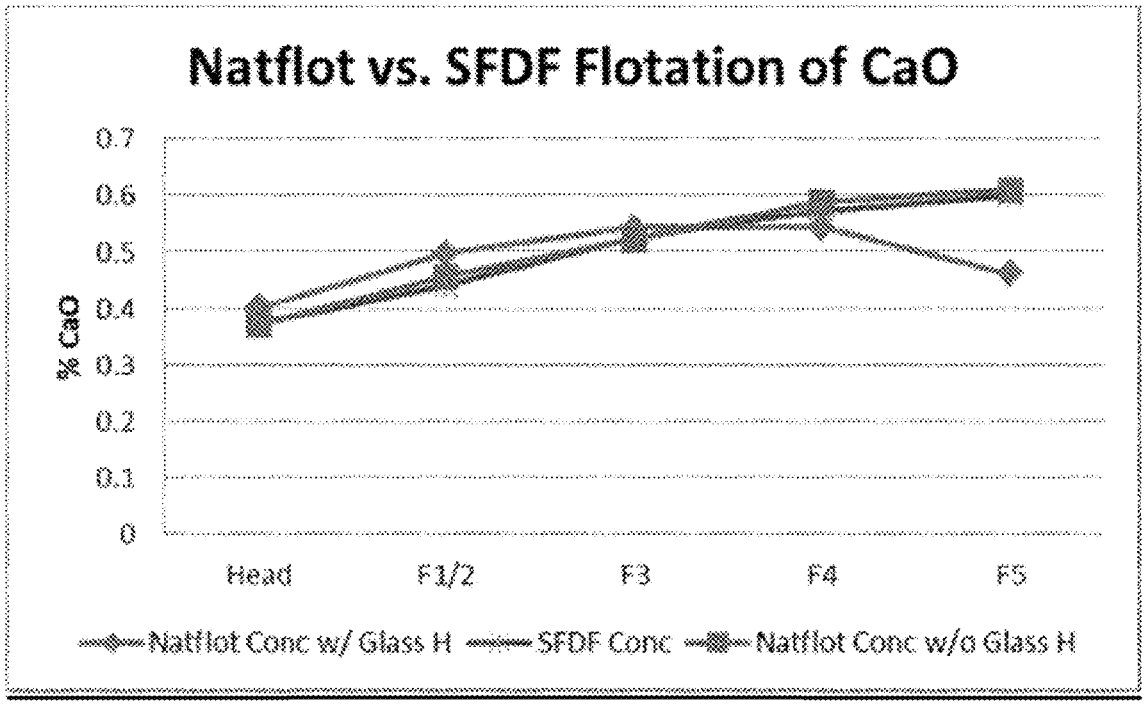
FIG. 16 is a graph of NatFlot vs SFDF concentrate CaO content.

In addition to the reduction of phosphorus the polyphosphate reagent addition also made a small reduction in other gangue minerals. In comparing the flotation response of NatFlot versus the SFDF process in respect to MgO and $Al_2O_3$, there was a significant difference in the removal of MgO and $Al_2O_3$ even without the addition of polyphosphate. The reduction of MgO and $Al_2O_3$ can be viewed in FIG. 14 and FIG. 15, respectively. There was slight reduction of CaO found when comparing the NatFlot to SFDF process as shown in FIG. 16.

The previous test work has shown that specific ions in the process water and starch as an additive in flotation improves the selectivity of flotation which increases both the concentrate grade and iron recovery. The UMD NRRI tap water works very well in the NatFlot process as it contains high amounts of calcium and magnesium ions. Since the process water sources for potential commercial application of the NatFlot process may need their calcium and magnesium levels adjusted, testing with demineralized water dosed with various sources of salts containing calcium, magnesium and other ions was initiated to determine which ions were optimal for the process.

Figure 17:
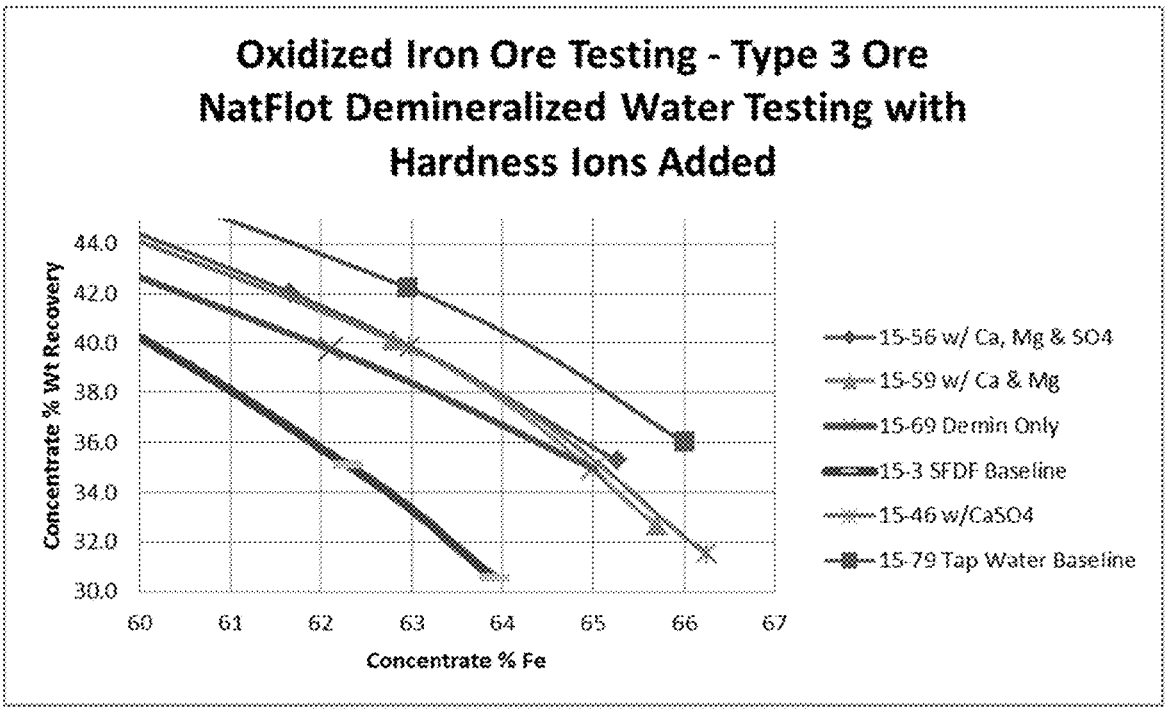
FIG. 17 is a graph of tap water and treated demineralized grade vs. SFDF recovery plot.

FIG. 17 shows the results with UMD NRRI high ion-loaded tap water compared to the treated demineralized water and the original SFDF high pH mining company test. Reagents $CaCl_2$, $Na_2SO_4$ and $MgCl_2$ were added to demineralized water to simulate the chemistry of the tap water. The recoveries with the two process waters were very close and significantly better than the SFDF high pH test.

The ions that improve the ability of starch to act as a flotation depressant are primarily calcium and magnesium with a divalent anion. Additional cations and some anions are envisioned to be within the scope of this disclosure.

Figure 18:
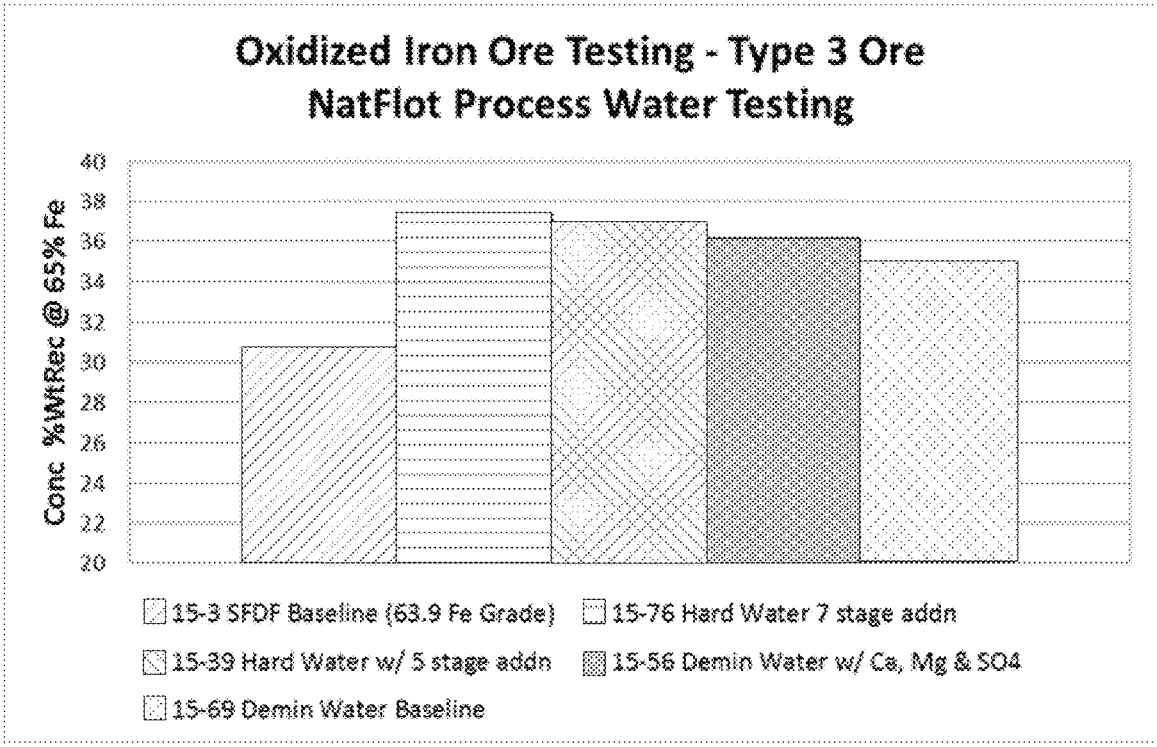
FIG. 18 is a bar graph of NatFlot process water testing.

The NatFlot test 15-56 with $Ca^{+2}$, $Mg^{+2}$ and $SO4^{-2}$ ion treated demineralized water approaches the result of tap water test 15-39 and shows that ion addition can be made to create the conditions for the process to work (see FIG. 18). Future locked cycle testing of the water system will help identify the carryover of these ions and what the make-up requirement will be.

Figure 19:
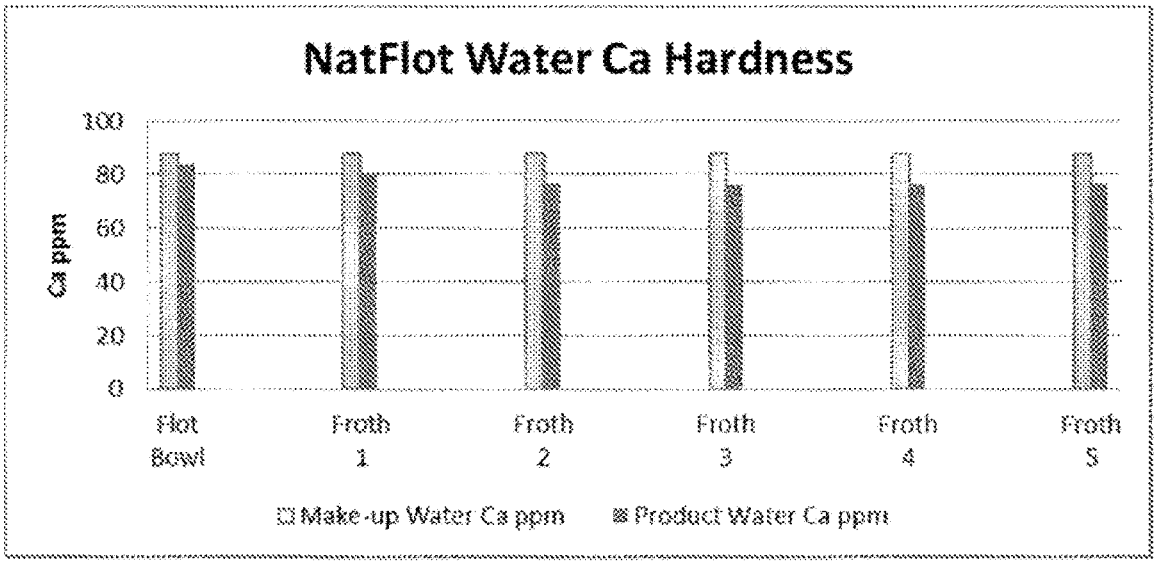
FIG. 19 is a bar graph of NatFlot calcium ion makeup water vs. product water.

The consumption of cations in the process water appears to be minimal, as can be seen in FIG. 19. The test results show that the cation additions needed for maintaining the ionic levels in the recirculated process water may be low.

An interesting finding of the test work is that the water used in grinding dolomite and limestone used for fluxed pellets has enough dissolved Ca and Mg along with carbonate to be a very effective water treatment for the process. In some embodiments, this water can be used without further addition of cations prior to use in the process.

Figure 20:
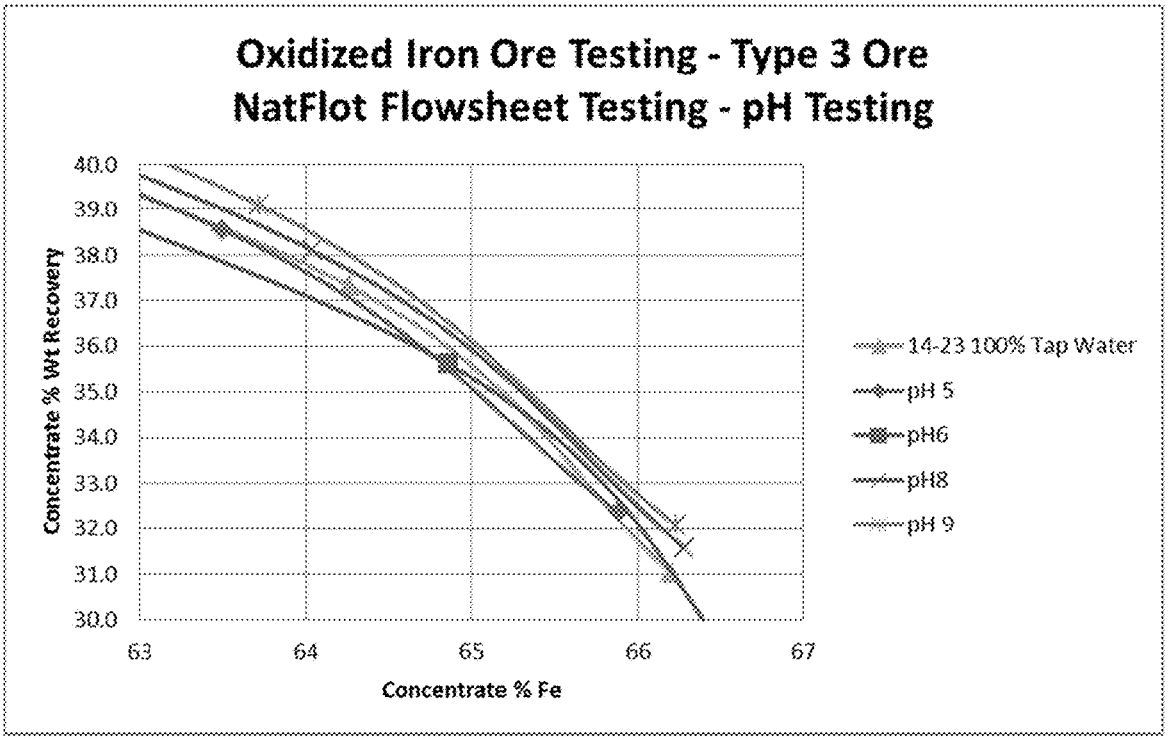
FIG. 20 is a graph of pH series grade vs. recovery plot.
Figure 21:
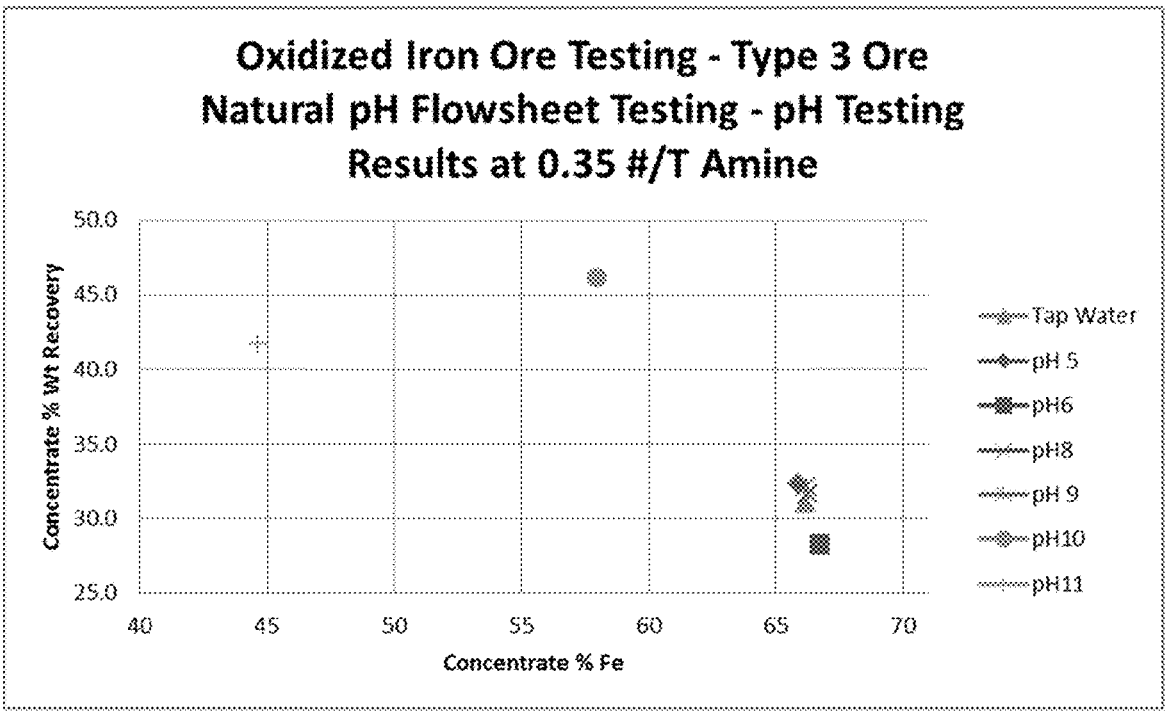
FIG. 21 is a graph of pH series results at 0.35#/LT amine.

A test series was run to evaluate the effect of pH on the NatFlot flotation procedure. A range of pHs from 5 to 9 in one pH unit steps were run with pH adjusted tap water. The tap water baseline Test 14-23 was used as the standard at a pH of 7.4. FIG. 20 shows the grade vs. recovery plot of the pH testing from 5 to 9. In the pH range of 5 to 9 the recovery curves were very tight, but there was a slightly better response as the pH increased. The response at a pH of 10 and 11 were very poor as seen in FIG. 21.

At a pH of 10 the selectivity was similar, but the final grade was lower because of the reduction in material floated at this amine dosage. At pH 11, the selectivity and floatability were both negatively impacted. The conclusion is that NatFlot works well until the pH approaches 10. This may be due to $Mg(OH)_2$ precipitating at this pH. Being able to perform well in the 6 to 9 pH range makes the NatFlot process very robust when considering the natural water sources and ore effects on pH for any commercial operation.

Figure 22:
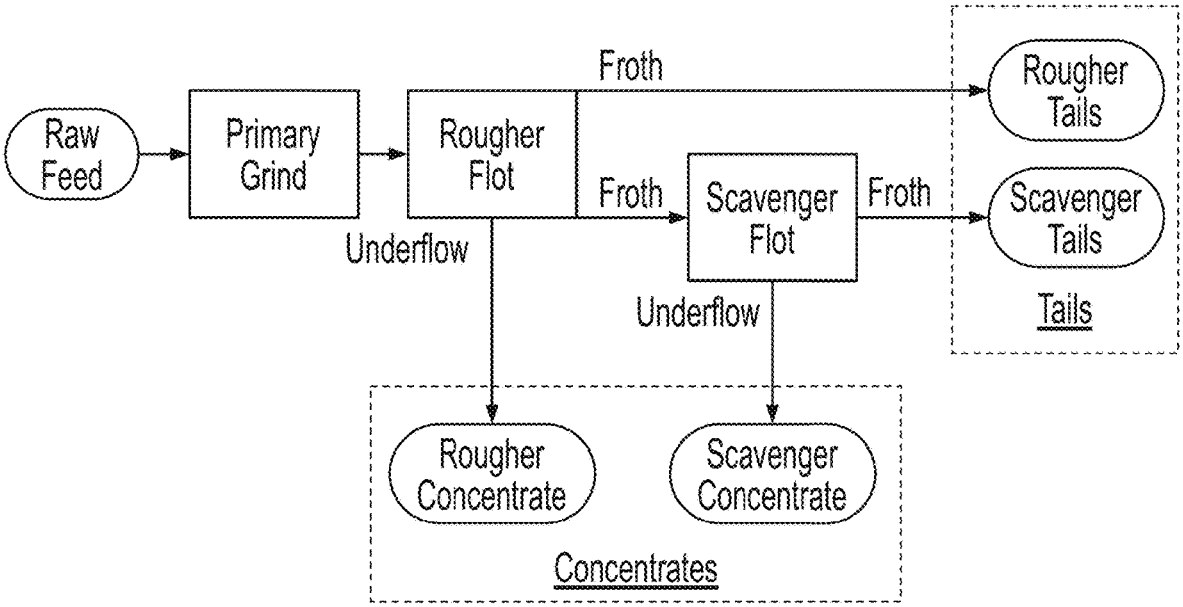
FIG. 22 is a flowsheet of NatFlot Rougher-Scavenger.

The iron content of the staged flotation froths are very low in the first amine additions and increase significantly with the final amine additions. Scavenging of these higher grade froths was attempted with several flowsheet options. The first option was to take the first froths to tailings and the last froths to the scavenger circuit. The froth was repulped and floated without grinding. This process flowsheet was referred to as the NatFlot Rougher-Scavenger flowsheet and can be seen in FIG. 22.

Figure 23:
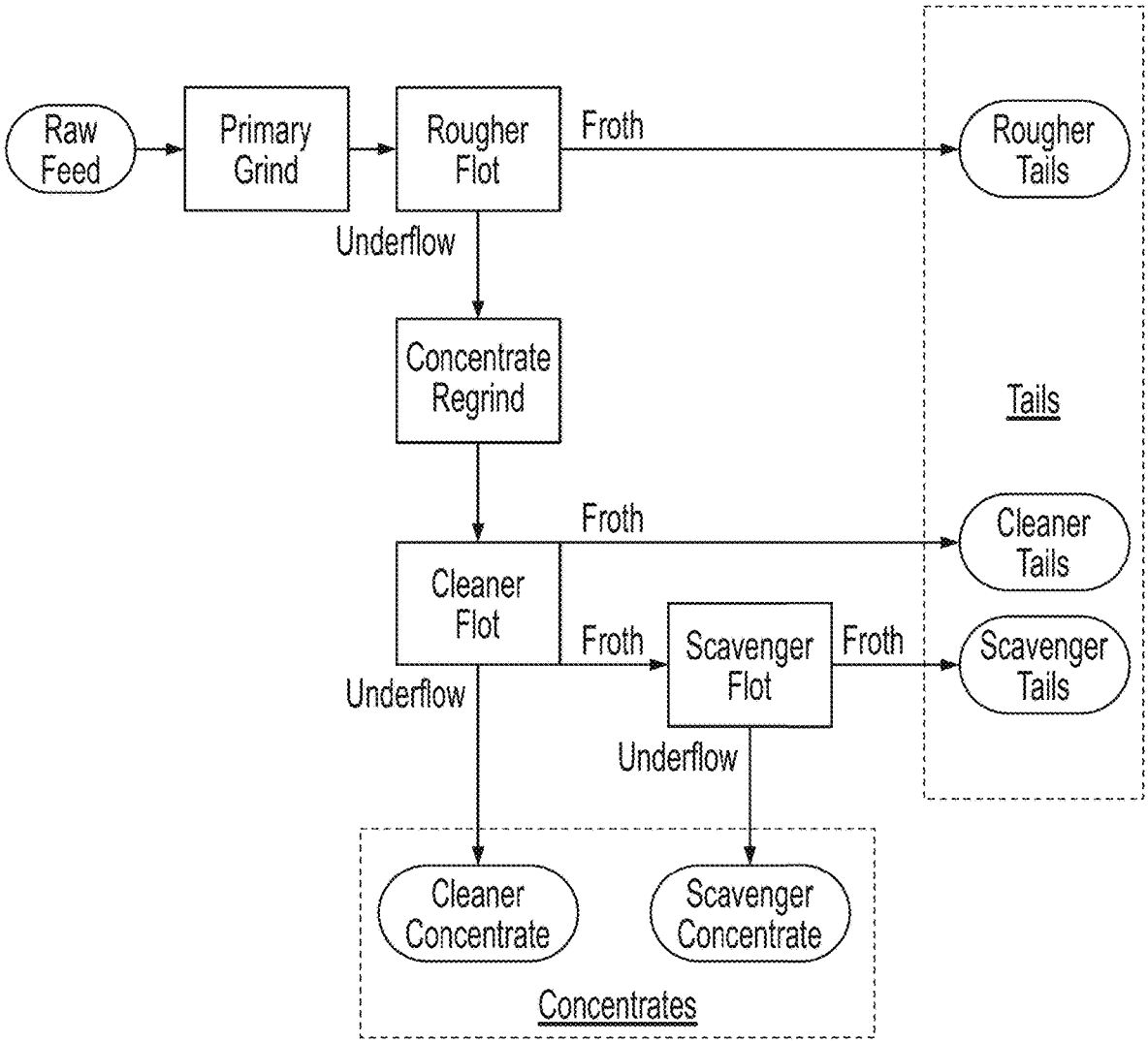
FIG. 23 is a flowsheet of NatFlot Regrind-Cleaner-Scavenger.

An alternative scavenger flowsheet involved making a lower grade rougher concentrate to maintain a high recovery. The rougher concentrate would then be sent to regrind to increase liberation and then subjected to a cleaner flot with a scavenger flot on the cleaner tails. This process flowsheet was referred to as the NatFlot Regrind-Cleaner-Scavenger flowsheet and can be seen in FIG. 23.

Figure 24:
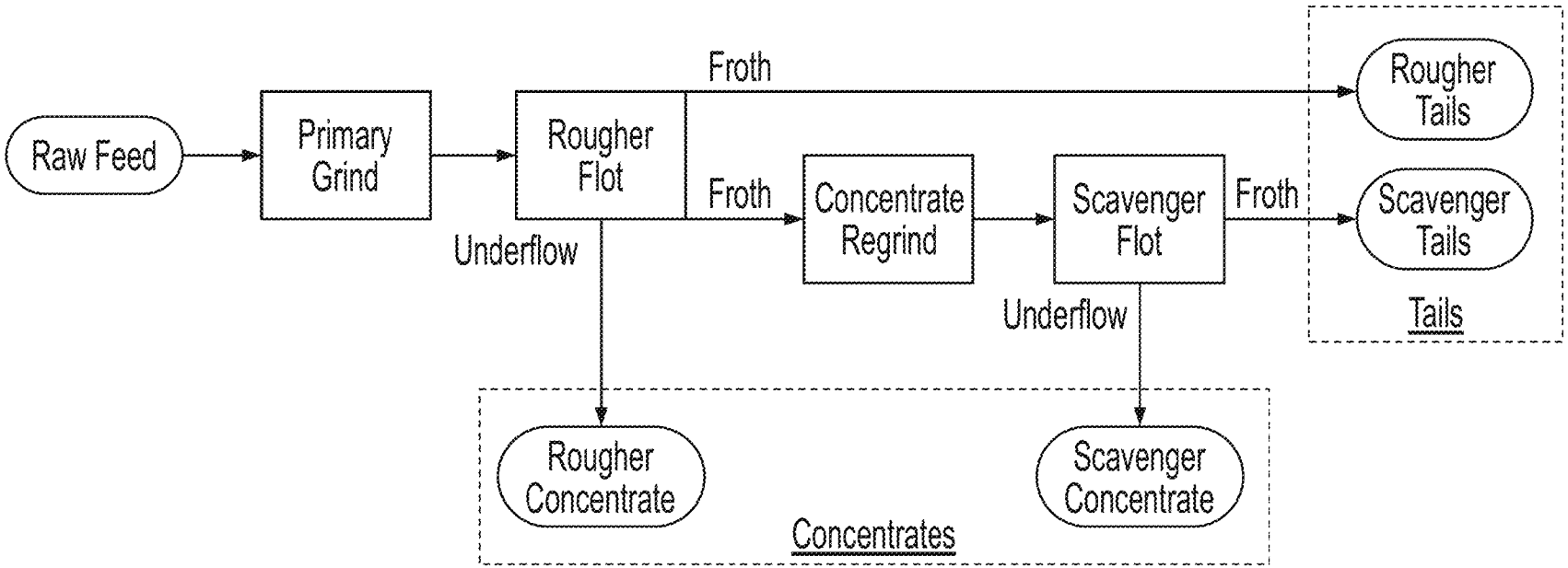
FIG. 24 is a flowsheet of NatFlot Rougher with Regrind-Scavenger.

The final scavenging alternative was to regrind the final stage rougher froth with a scavenger flot to produce a scavenger concentrate. This process flowsheet was referred to as the NatFlot Rougher with Regrind-Scavenger flowsheet, as seen in FIG. 24.

Figure 25:
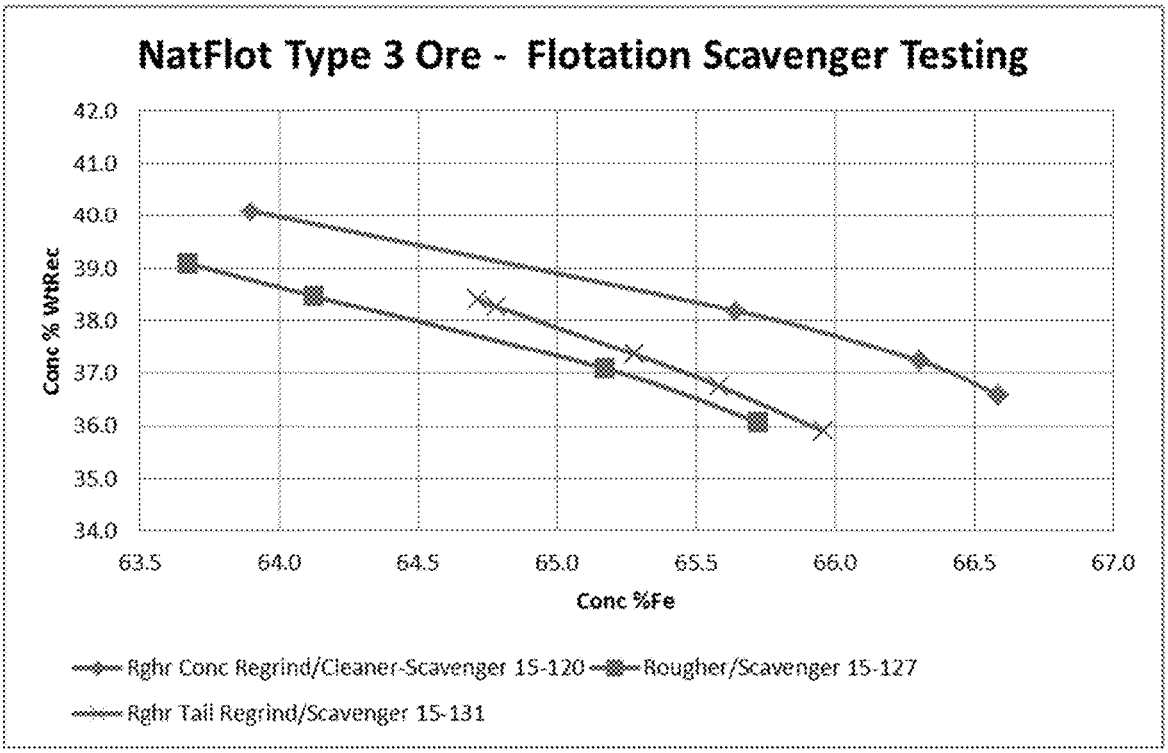
FIG. 25 is a graph of comparison of the NatFlot flowsheets with flotation scavenging.

The testing to date has shown that the best grade/recovery relationship was realized with the NatFlot Regrind-Cleaner-Scavenger flowsheet. Test 15-120 shows that by producing a low-grade rougher concentrate, regrinding, cleaning, and scavenging, the highest recovery was found. The grade/recovery graph for each of these flowsheets can be seen in FIG. 25.

The metallurgical balances for NatFlot Rougher-Scavenger Test 15-127, NatFlot Rougher with Regrind-Scavenger Test 15-120, and NatFlot Rougher with Regrind-Scavenger Test 15-131 can be seen in FIGS. 26, 27, and 28, respectively.

One of the functions of a desliming circuit in industrial concentrating plants is to remove the ultra-fine particles going into flotation. The SFDF process uses chemical dispersion and starch as a selective flocculant to remove a large amount of fine silica before flotation. Some circuits deslime with cyclones that reject the very fine materials unselectively resulting in higher iron losses. The NatFlot flowsheet does not deslime. The risk is that the commercial plant will not be able to handle the volume and tenacity of the flotation froth without proper desliming. Amine froths are mineral stabilized and the presence of slimes will typically make the froth unmanageable. This study is aimed at negating the difficult froth problem experienced in plant operations.

The staged addition of amine and keeping the amine concentration low in the beginning of flotation is the most successful method to improve flotation selectivity and eliminate highly stable froth. The first amine addition is critical to control the volume, bubble size and durability of the froth. By using multiple stages of flotation with small increments of amine, the froth becomes very manageable with larger bubbles that are easily broken.

In some embodiments, anionic polymer flocculants can be used to break down the froth going to the tailings. The anionic polymer can provide the benefit of flocculating the fine slimes stabilizing the froth, which causes the froth to become more manageable. In some embodiments, the applicability of wet high-intensity magnetic separation (WHIMS) to deslime can be applied to the processes described herein. If a scavenger circuit is desirable, not recirculating the scavenger concentrates to the rougher flotation could assist with froth control, in some embodiments. In certain embodiments, any of the processes provided herein can include a stand-alone scavenger cleaner flotation circuit and produce a separate scavenger concentrate.

A few exploratory tests were conducted to attempt to produce a low silica concentrate below 2%. A rougher concentrate was produced with the NatFlot standard flowsheet that had a 31.5% weight recovery at a 66.25% total iron and 3.37% silica. This concentrate was reground and stage floated again to produce a 67.6% total iron and 1.97% silica concentrate with a final weight recovery of 26.6% and an iron recovery of 51.6%. This demonstrates this process and ore can produce a low silica concentrate.

Figure 29:
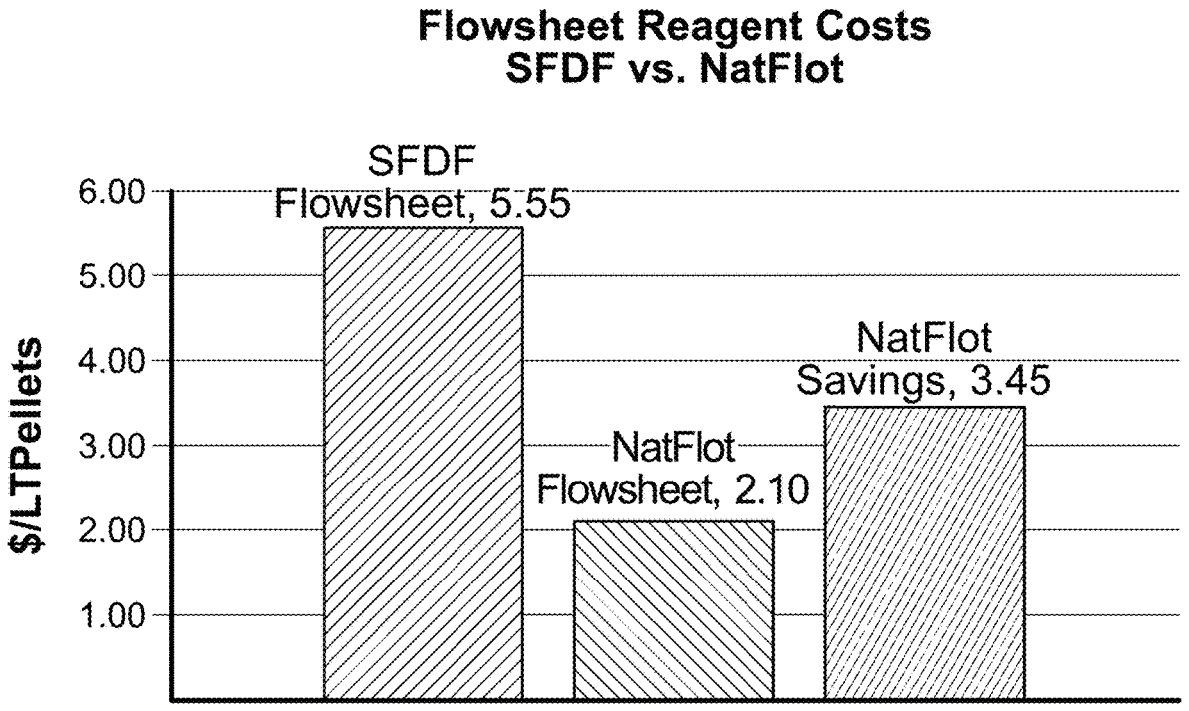
FIG. 29 is a projected reagent cost for SFDF vs. NatFlot.
Figure 30:
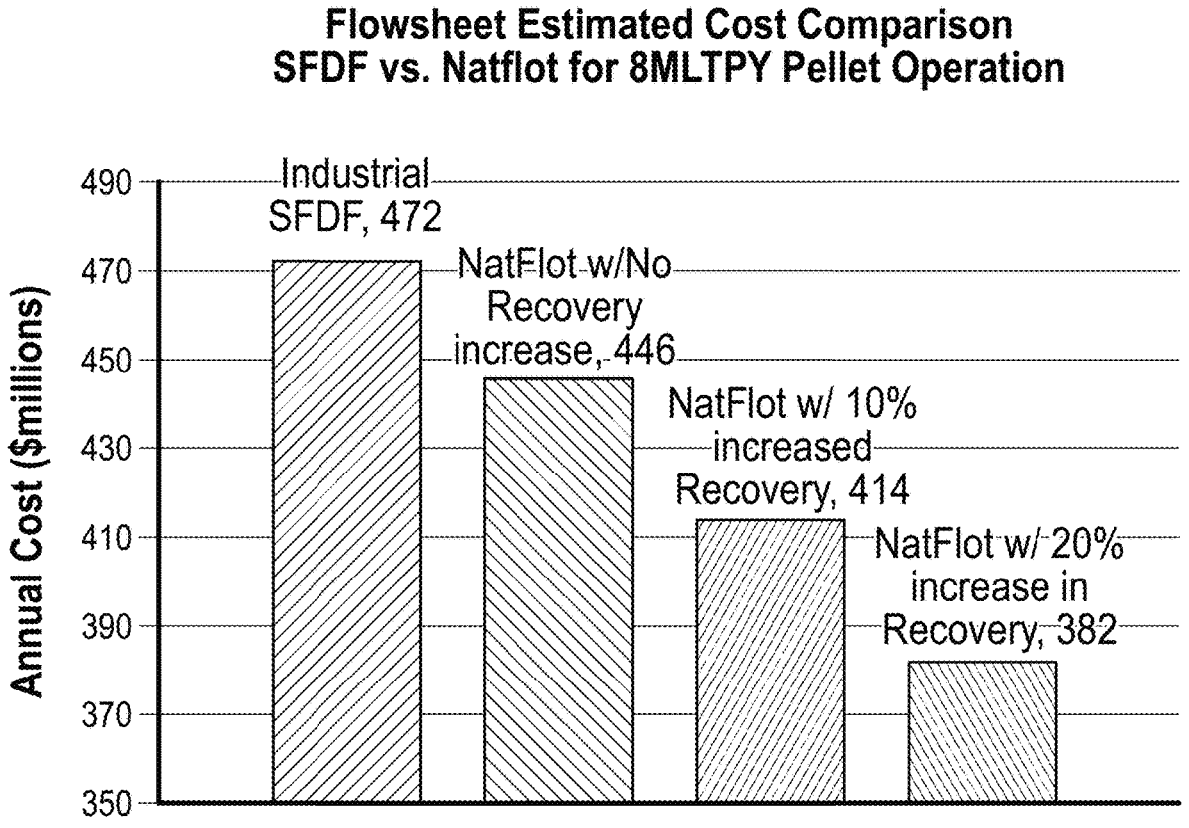
FIG. 30 is a projected annual operating cost for SFDF vs. NatFlot.

The estimated current reagent costs can be seen in FIG. 29. It is estimated that in an eight million ton pellet plant, the annual reagent savings would be in the $10 to $20 million range. If the recovery improvement is realized, the projected total annual costs can be seen in FIG. 30.

Nearly all of the work done on this project has been with the Oxidized Type 3 iron ore sample. The objective was to explore all the variables to create a flowsheet that is optimized with this ore. By identifying the impacts of these variables on this ore sample with this flowsheet, it provides opportunities to adjust the flowsheet variables to suit other ores that will differ in mineralogy. It is expected that ores with more earthy hematites and goethites will need more aggressive froth control measures. Other examples of some ores that could be considered as applicable in some embodiments include at a minimum: Tilden Mine—change their flowsheet from the SFDF high pH; Essar Oxidized flowsheet currently being developed; Hibbing Taconite as they are depleting their magnetite taconite; Magnetation as they are developing oxidized ore processing; and typical oxidized Minnesota ores from drill core in the upper and lower cherty zones.

In some embodiments, the starch employed is causticized modified starch, as the primary reactant used as a flotation depressant of oxidized iron ores. This modified starch is typically formed by adding the starch polymer to an alkaline solution to produce a causticized starch polymer.

While PA-12 amine (dodecyl amine) was the primary reactant used as flotation collector for floating the silica, the methods provided herein are not limited to this amine. In some embodiments, alkyl amines having between 2-20 carbons are believed to have a value and can be a suitable flotation collector. While not wanting to be held by any one theory or mode of operation, it is believed that under some circumstances, and depending upon solubility requirements and characteristics, aromatic amines may also be suitable flotation collectors, and can include amines having between 6-40 carbon atoms and one aromatic and/or cycloaliphatic ring contained therein.

The examples provided herein are illustrative only and not meant to limit the claimed embodiments encompassed within this disclosure. This disclosure has been described with reference to preferred and alternate embodiments. Obviously, modifications and alterations will occur to others upon the reading and understanding of the specification. It is intended to include all such modifications and alterations insofar as they come within the scope of the appended claims or the equivalents thereof.

What is claimed is:

1. A process to beneficiate oxidized iron ore comprising the steps of:

adding a polysaccharide to the oxidized iron ore;

adding at least one amine, wherein adding at least one amine comprises:

adding at least one amine in a first stage at a first increment; and after the first stage, adding at least one amine in a subsequent stage at a second increment different from the first increment; and adding at least one salt, wherein the pH of the process is below 10 and greater than 5.

2. The process of claim 1 wherein the polysaccharide comprises:

polysaccharide carbohydrates $(C_6H_{10}O_5)_n$ consisting of a number of glucose monosaccharide units joined together by glycosidic bonds; and wherein n ranges from 2 to 1,000 inclusive.

3. The process of claim 1 wherein the polysaccharide is a causticized starch.

4. The process of claim 1 wherein the at least one amine is an alkyl amines having between 2-20 carbons.

5. The process of claim 4 wherein the at least one amine is dodecyl amine.

6. The process of claim 1 wherein the at least one amine is an aromatic amine having between 6-40 carbon atoms.

7. The process of claim 1 wherein the at least one amine is a cycloaliphatic amine.

8. The process of claim 1 wherein said at least one salt comprises a cation selected from the group consisting of magnesium, calcium and sodium.

9. The process of claim 8 wherein said at least one salt comprises a divalent cation.

10. The process of claim 9 wherein said at least one divalent cation is selected from the group consisting of magnesium and calcium.

11. The process of claim 1 wherein said pH is between 6 to 9 inclusive.

12. The process of claim 1 wherein said step of adding at least one amine comprises adding at least one amine in three or more stages.

13. The process of claim 12 wherein said step of adding at least one amine comprises adding at least one amine in four or more stages.

14. The process of claim 13, wherein said step of adding at least one amine comprises adding at least one amine in five or more stages.

15. The process of claim 1 wherein said step of adding at least one amine comprises adding at least one amine in between 2 to 5 stages inclusive.

16. The process of claim 1 wherein said step of adding at least one amine comprises adding at least one amine in between 3 to 5 stages inclusive.

17. The process of claim 1 wherein said step of adding at least one amine comprises adding at least one amine in between 4 to 5 stages inclusive.

18. The process of claim 11 wherein no desliming step is performed.

19. The process of claim 1 which further comprises the step of:

adding at least one polyphosphate activator.

20. The process of claim 19 wherein the beneficiated iron ore concentrate contains less than or equal to 0.100% phosphorus.

21. The process of claim 20, wherein a beneficiated iron ore concentrate contains less than or equal to 0.020% phosphorus.

22. A process to beneficiate oxidized iron ore comprising:

adding a causticized starch to the oxidized iron ore;

adding at least one amine to the oxidized iron ore, wherein adding at least one amine to the oxidized iron ore comprises:

adding at least one amine to the oxidized iron ore in a first stage at a first increment; and after the first stage, adding at least one amine to the oxidized iron ore in a subsequent stage at a second increment greater than the first increment;

adding at least one polyphosphate activator; and adding at least one salt;

wherein the pH of the process is between approximately 6 and 9 inclusive; and wherein no desliming step is performed.

23. The process of claim 22, wherein a beneficiated iron ore concentrate contains less than or equal to 0.100% phosphorus.

24. The process of claim 23, wherein the beneficiated iron ore concentrate contains less than or equal to 0.050% phosphorus.

25. The process of claim 24, wherein the beneficiated iron ore concentrate contains less than or equal to 0.020% phosphorus.

26. The process of claim 1, wherein the second increment is greater than the first increment.

27. The process of claim 26, wherein the first increment is about 0.05 pounds per ton.

* * * * *